US006607246B1

(12) United States Patent
Benden

(10) Patent No.: US 6,607,246 B1
(45) Date of Patent: Aug. 19, 2003

(54) FOOTREST FOR A CHAIR

(75) Inventor: Mark E. Benden, College Station, TX (US)

(73) Assignee: Neutral Posture Ergonomics, Inc., Bryan, TX (US)

( * ) Notice: Subject to any disclaimer, the term of this patent is extended or adjusted under 35 U.S.C. 154(b) by 0 days.

(21) Appl. No.: 09/654,754

(22) Filed: Sep. 5, 2000

Related U.S. Application Data

(63) Continuation-in-part of application No. 09/232,777, filed on Jan. 19, 1999, now Pat. No. 6,142,571.

(51) Int. Cl.[7] ..... A47C 16/00
(52) U.S. Cl. ..... 297/423.4
(58) Field of Search ..... 297/423.4, 423.1, 297/423.19, 423.2, 423.22, 423.23, 423.25, 440.1, 463.1, 423.39; 248/188.8, 188

(56) References Cited

U.S. PATENT DOCUMENTS

| | | | | |
|---|---|---|---|---|
| 344,675 A | | 6/1886 | Ordway | |
| 1,933,096 A | | 10/1933 | Child | 155/165 |
| 2,529,780 A | | 11/1950 | Miller | 155/95 |
| 4,023,859 A | * | 5/1977 | Hagenson | |
| 4,119,286 A | | 10/1978 | Barril | 248/188 |
| 4,171,847 A | | 10/1979 | Tukui | 297/5 |
| 4,767,160 A | * | 8/1988 | Mengshoel et al. | |
| 4,915,450 A | | 4/1990 | Cooper | 297/423 |
| 5,098,160 A | | 3/1992 | Moore et al. | 247/423 |
| 5,344,217 A | | 9/1994 | McLanghlin | 297/423.25 |
| 5,419,618 A | | 5/1995 | Hatcher | 297/423.46 |
| 5,501,419 A | | 3/1996 | Huang | 248/188.7 |
| 5,577,806 A | | 11/1996 | Ugalde | 297/423.46 |
| D401,088 S | | 11/1998 | Chen | D6/498 |
| 5,836,555 A | | 11/1998 | Ellsworth et al. | 248/161 |

FOREIGN PATENT DOCUMENTS

GB 326850 3/1930

OTHER PUBLICATIONS

3M Adjustable Footrest Information available on the world wide web on Dec. 22, 1998 at 3M's home page at: www.3m.com/market/omc/catalog/products/p00/p22/p83.html.

* cited by examiner

*Primary Examiner*—Milton Nelson, Jr.
(74) *Attorney, Agent, or Firm*—Howrey Simon Arnold & White, LLP

(57) ABSTRACT

A footrest apparatus is described for use in the field of workstation design. The footrest apparatus comfortably supports the chair user's feet and includes a support section and a connecting section. The footrest apparatus may be detachably connected to chair legs. The footrest apparatus may be adjusted to accommodate chairs of different sizes.

20 Claims, 24 Drawing Sheets

FOOTREST FOR A CHAIR

CROSS-REFERENCE TO RELATED APPLICATIONS

This application is a continuation-in-part of application Ser. No. 09/232,777, filed Jan. 19, 1999, now U.S. Pat. No. 6,142,571, entitled "Footrest Apparatus for a Chair," incorporated herein in its entirety by reference.

FIELD OF THE INVENTION

The invention relates to a footrest for a chair. More particularly, this invention relates to a footrest apparatus for maintaining the user's feet in a comfortable position. Further, this invention relates to a footrest that may be utilized for various sizes of chairs.

DESCRIPTION OF THE RELATED ART

In the workplace, persons such as machine operators and secretaries are often required to perform repetitive manual tasks in a sedentary position. Without proper support of the body, the person can become fatigued and possibly subjected to repetitive-motion injuries. It is now known that utilizing ergonomic principles in workstation design can help increase worker productivity, decrease worker fatigue, and reduce the likelihood of possible repetitive-motion injuries.

One area in which this proper support is especially necessary is the support of the feet of a seated person. Without proper support of the feet, the feet and legs may be deprived of much-needed circulation. Unsupported feet tend to cause the seated person's ankles to swell. Not only is this unsupported position uncomfortable, but this position also leads to worker fatigue. Without proper support for the legs, proper circulation is hampered. Conversely, proper foot support facilitates blood flow through the legs which helps prevent fatigue and improves worker comfort.

It is commonly known in the workplace design industry that it is possible to provide free-standing footrests that are not directly attached to the chair of a seated person. However, the addition of another piece of furniture in the work area is not always desirable in many space-limited workplace designs. Further, chairs are often supported by legs with wheels or rollers. So it is possible that when a person places his feet on a separate footrest, he and his chair can roll away from the footrest.

It is also known to provide a grooved surface for these free-standing footrests to help prevent feet from sliding off the footrest surface. However, these grooves tend to retain dirt and generally do not provide sufficient traction to hold the feet in a secure, comfortable position.

Another conventional method of supporting the feet of a seated person in the workplace is by mounting a solid, typically metal ring or footring on the legs of a chair to support the feet of a seated person. However, because of the design of the legs of industrial chairs, these ringed supports hold the feet too far off the floor and position the feet at an uncomfortable, and ergonomically improper, angle. Further, because this type of support is permanently mounted, the adding or removing these supports to chairs can be difficult.

These footring footrests also cause complications if one chair is to be used by more than one person, such as in a multiple work-shift operation. When more than one person uses a chair, it is possible that one person may desire to use the footrest and another may not. Because these footring footrests circumscribe the chair legs and are permanently mounted to the chair legs, such a chair cannot be utilized by a person who does not want to use the footrests.

The footring footrests also are problematic when used on chairs of different sizes. It is known that chairs of many different sizes are used in the industrial workplace. For example, it is generally known that industrial chairs are utilized with legs having different lengths, each chair having legs of uniform length. A single, nonadjustable footring footrest having a given radius generally may not be used to properly support a user's feet on chairs of two different sizes. For example, if the footring's radius is 23" and the chair leg length is 21", the footring will not be supported. Similarly, if the chair leg length is 27" and the radius of the footring footrest is only 21", a user's feet will likely not reach the footring in a comfortable position. Thus, a footring footrest should have a radius closely associated with the length of the chair legs upon which it is mounted: and chairs having different lengths of legs will require different sized footring footrests. Having to provide correctly-sized footrests therefore increases the number of footrests required for a given number of chairs in a work area, thus increasing the associated costs.

For the foregoing reasons, there is a need for a footrest that can support the feet at a comfortable angle. Further, there is a need for one footrest that may be adjustable for use with chairs having chair legs of different sizes.

SUMMARY OF THE INVENTION

In some aspects, the present invention relates to an apparatus and a method to support the feet of a person sitting in a chair. Specifically, according to one aspect of the invention, a footrest apparatus is designed for use in combination with a chair having a plurality of substantially horizontally extending legs, comprising one or more support sections adapted to receive the bottom surface of a user's foot or footwear, and one or more connecting sections functionally associated with said support sections, said connecting sections being detachably mounted on one or more legs of said chair, the upper surfaces of said one or more support sections being located below the upper surface of said substantially horizontal legs.

In some embodiments, the upper surface of each support section is angled from a horizontal plane. In some embodiments, this angle is between about 10 degrees and about 40 degrees. In some embodiments, this angle is approximately 30 degrees.

In some embodiments, each support section is substantially curvilinear. In some embodiments, the upper surface of each supporting section is provided with tactile bumps. In some embodiments the upper surface of each supporting section is further provided with tactile grooves.

In some embodiments, each connecting section further comprises an inside radius, each chair leg has an outside radius, the said inside radius of each connecting section being approximately equal to the outside radius of each chair leg to detachably connect the connecting sections to the chair legs.

In some embodiments, the footrest apparatus comprises a fastener attached to each connecting section for connecting the connecting sections to the chair legs. In some embodiments, the fastener is a nail. In some embodiments the fastener is a screw; in some embodiments the fastener is glue. In some embodiments, the fastener comprises each connecting section having an inside radius, each chair leg having an outside radius, the inside radius of each connecting section being approximately equal to said outside radius of each chair leg.

In another aspect, the footrest apparatus is designed for use in combination with a chair having five substantially horizontally extending legs, comprising two support sections adapted to receive the bottom surface of a user's foot or footwear, each support section being substantially curvilinear, and three connecting sections functionally associated with said support sections said connecting sections being detachably mounted on one or more legs of said chair, the upper surface of both support sections being located below the upper surface of said substantially horizontal legs, said upper surface of both support sections being angled from a horizontal plane at an angle of approximately 30 degrees and having tactile bumps, each connecting section further comprising an inside radius being approximately equal to an outside radius of each chair leg to detachably connect each connecting section to the chair legs.

In another aspect, a footrest apparatus is designed for use in combination with a chair having substantially horizontally extending legs, comprising at least one support section, each support section having a first end, a second end, and an upper surface adapted to receive the bottom surface of a user's foot or footwear, and means for detachably connecting each foot support section to one or more legs of said chair, said means being integrally connected to each end of each support section; each upper surface of each support section being located below the upper surface of the substantially horizontal chair legs. In some embodiments, each upper surface of each support section forms an angle to a horizontal plane.

In some embodiments, the angle the upper surface of each support section forms with the horizontal plane is between about 10 degrees and about 40 degrees. In some embodiments, this angle is approximately 30 degrees.

In another aspect, a method of supporting a seated person's feet on a chair having a plurality of substantially horizontally extending legs is provided comprising providing one or more support sections adapted to receive the bottom surface of a user's foot or footwear, providing at least two connecting sections functionally associated with said support sections, and connecting the corresponding supporting section to the chair leg. In another aspect, a method of supporting a seated person's feet on a chair having a plurality of substantially horizontally extending legs is provided comprising providing a footrest apparatus comprising one or more support sections having an upper surface, and at least one connecting section associated with each support section and adapted to connect the support section between adjacent chair legs so that the upper surface of each support section is below an upper surface of each adjacent chair leg, and engaging each connecting section to a chair leg.

In some aspects, the present invention relates to a footrest and a method to support the feet of a person sitting in a chair. Specifically, according to one aspect of the invention, a footrest for use with different sizes of chairs is described for chairs having a plurality of substantially horizontally-extending legs. The footrest comprises a support section adapted to receive a bottom surface of a user's footwear. The support section also has a first end and a second end. A first connector is removably attached to one of the plurality of the substantially horizontally-extending legs of the chair. The first connector is removably attached to the first end of the support section thus defining a first adjustable element. A second connector is removably attached to one of the plurality of the substantially horizontally-extending legs of the chair. The second connector is also removably attached to the second end of the support section thus defining a second adjustable element. The first and the second adjustable elements allow the support section to be used for chairs of different sizes.

In some embodiments, the first adjustable element further comprises a connecting means. In these embodiments the first connector has at least one hole and the first end of the support section has at least one hole. The first end of the support section has a slot to receive the first end of the first connector. The connecting means attaches the first end of the support section to the first end of the first connector by alignment of the hole in the first end of the first connector with the hole in the first end of the support section. In some embodiments, the first connector is an elongated slot. In some embodiments, the at least one hole in the first end of the support section is an elongated slot.

In some embodiments, the first connector is an L-segment being inserted into a slot on the first end of the support section. In others, the first adjustable element is a T-segment being inserted into a slot on the first end of the support section. In some embodiments, an upper surface of the support section further comprises grooves or tactile bumps. In others, the upper surface of the support section is angled from a horizontal plane, the angle being between 10° and 40° in some embodiments, and 30° in others.

Also described is a footrest for use with different sizes of chairs, the chairs having a plurality of substantially horizontally-extending legs. These embodiments of the footrest have at least one support section adapted to receive a bottom surface of a user's footwear and a plurality of connectors. Each connector is removably attached to one of the plurality of the substantially horizontally-extending legs of the chair. Each connector is removably attached to at least one support section by at least one adjustable element. The at least one adjustable element allows the footrest to be used for chairs of different sizes. In some embodiments, at least one of the plurality of connectors is a T-segment or an L-segment.

In another aspect, a method of supporting a user's footwear on different sizes of chairs is described for the chairs having a plurality of substantially horizontally-extending legs. The method comprises providing a footrest having at least one support section adapted to receive a bottom surface of a user's footwear, and a plurality of connectors, each connector being removably attached to one of the plurality of the substantially horizontally-extending legs of the chair, each connector being removably attached to at least one support section by at least one adjustable element. The at least one adjustable element allows the support section to be used for chairs of different sizes. The method also comprises attaching the plurality of connectors to the substantially horizontally-extending chair legs and attaching the connectors to the at least one support section to support the user's footwear.

DESCRIPTION OF ILLUSTRATIVE EMBODIMENTS

Embodiments of the invention will now be described with reference to the accompanying figures.

The invention relates to an apparatus and a method to support a person's feet while seated. In some embodiments, the footrest apparatus supports the person's feet without adding another piece of furniture to work area: the footrest is attached to the chair legs. In some embodiments, the footrest rests below the upper surface of the chair legs thus making the footrest closer to the floor and more comfortable to the user than prior footrests. In some embodiments, the feet-supporting section of the footrest is angled to provide additional comfort for the user. In some embodiments, an adjustable element is formed when connecting the support section to the chair legs via connectors. In this way, one footrest may be utilized to accommodate chairs of different sizes as determined by the length of the chair legs.

Further aspects and advantages of the various embodiments of the invention will become apparent from consideration of the following description and drawings.

Figure 1A:
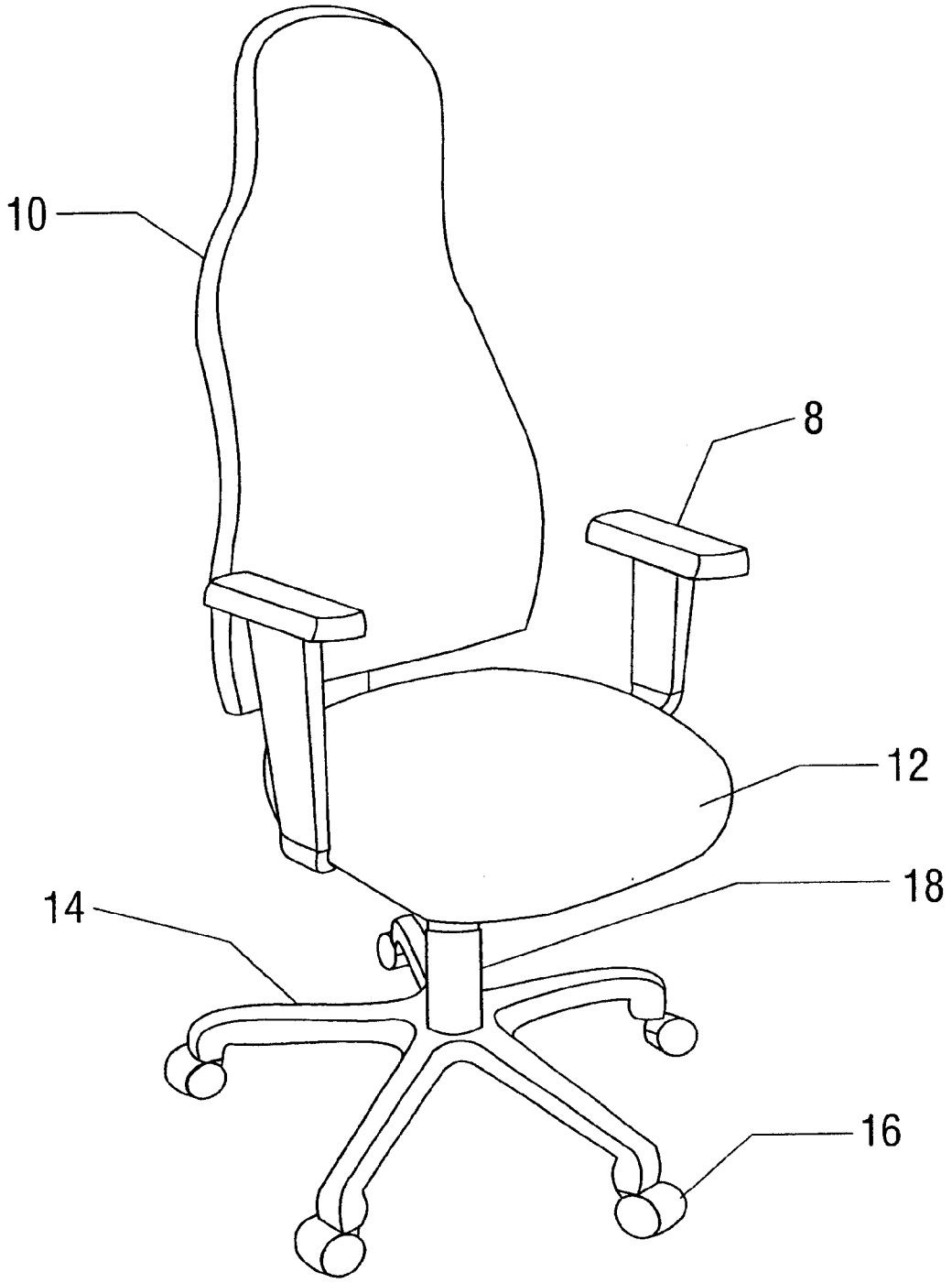
FIG. 1A (Prior Art)
FIG. 1A shows a prior art chair.

Referring to FIG. 1, a prior art industrial chair is shown to be made up for a chair back 10, a chair arm 8, a seat 12, resting on a support column 18 supported by chair legs 14 and chair rollers or castors 16. Chair legs 14 are substantially horizontally extending legs. In operation a person (not pictured) sits in seat 12.

Figure 1B:
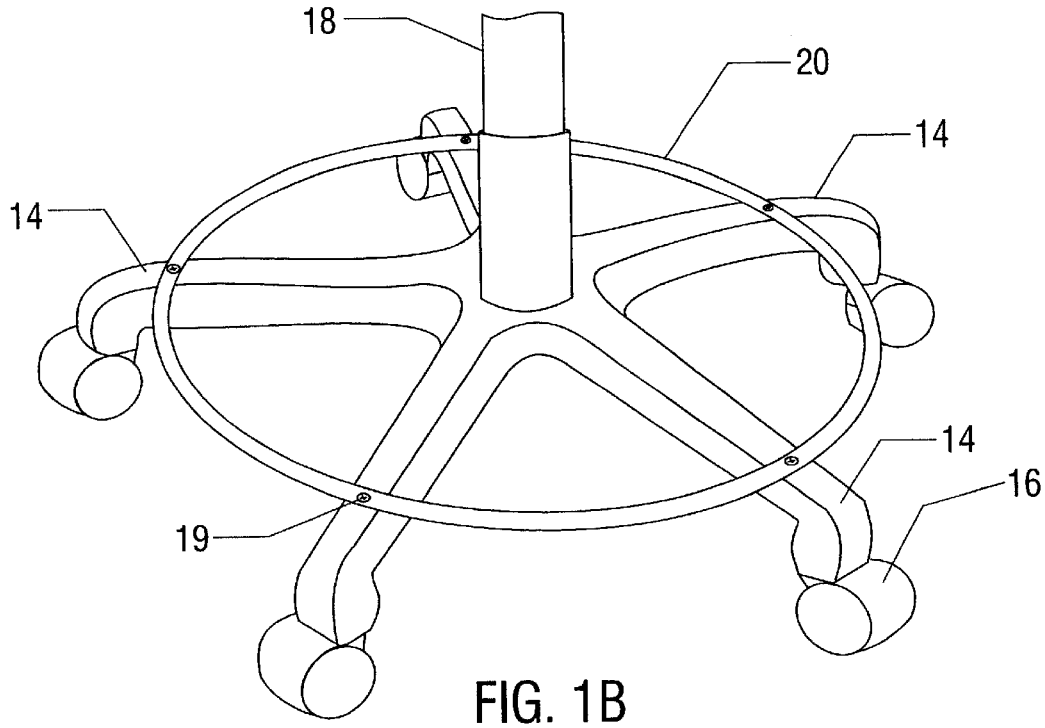
FIG. 1B (Prior Art)
FIG. 1B shows a prior art footring footrest.
Figure 1C:
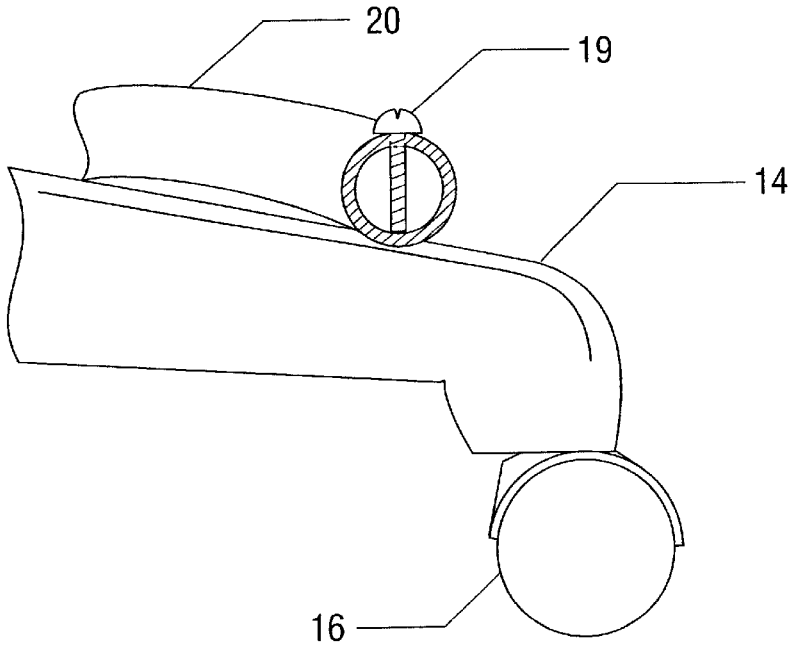
FIG. 1C (Prior Art)
FIG. 1C shows a cross section of the prior art footring footrest.

Referring to FIGS. 1B–1C a prior art footring 20 footrest is shown. Footring 20 is mounted on chair legs 14 by screws 19. In operation a person (not shown) rests her feet on footring 20. As shown in FIG. 1B, the footring 20 totally circumscribes the chair around the chair legs 14. Further as shown in FIG. 1C, footring 20 lies above chair legs 14.

Figure 2A:
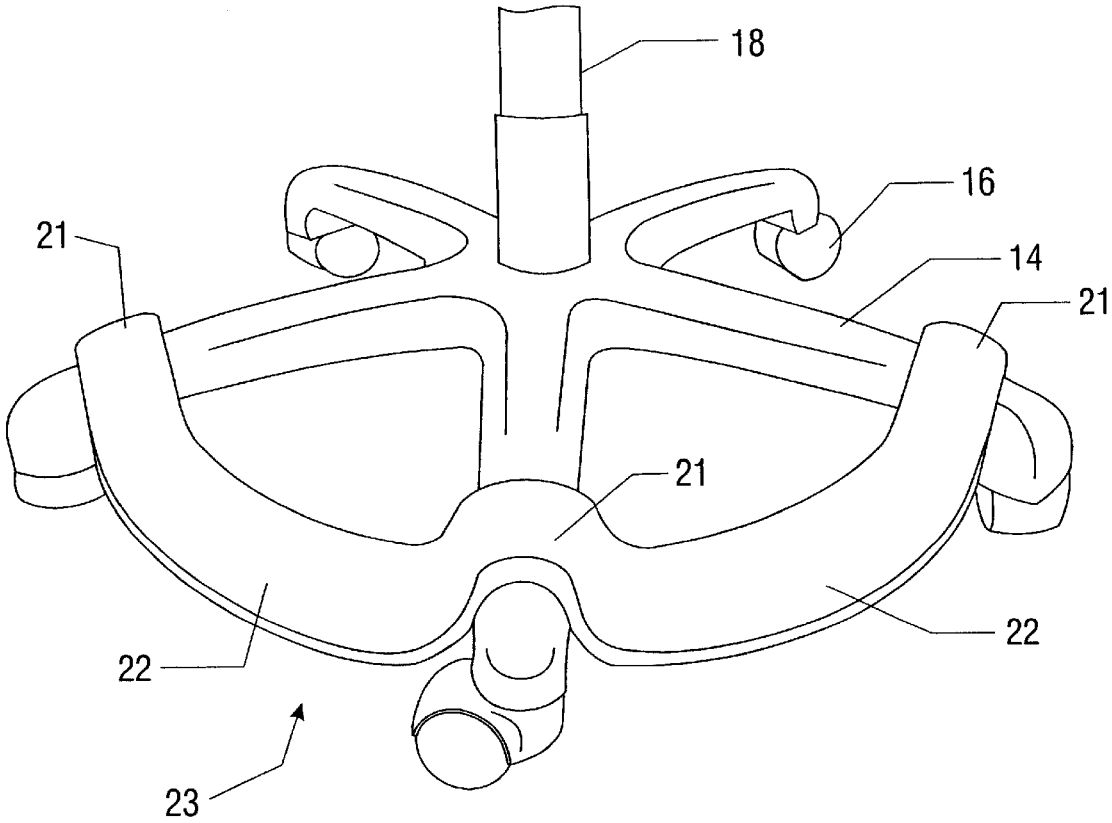
FIG. 2A shows an embodiment of the invention.

Referring to FIG. 2A, one embodiment of the present invention is shown. In this embodiment a footrest apparatus 23 is comprised of two support sections 22 and three connecting sections 21. The support sections 22 are adapted to receive the bottom surface of a user's feet or footwear. In operation a seated person (not pictured) rests his feet on support section 22. On each end of support section 22 is located a connecting section 21. Connecting section 21 connects each supporting section 22 to adjacent chair legs 14 as shown. Thus, in this embodiment, some of the adjacent legs are provided with a footrest between them and some are not. Thus, in these embodiments, the chair can be utilized by persons desiring the footrests and by persons not desiring the footrest simply by rotating the chair seat.

Figure 2B:
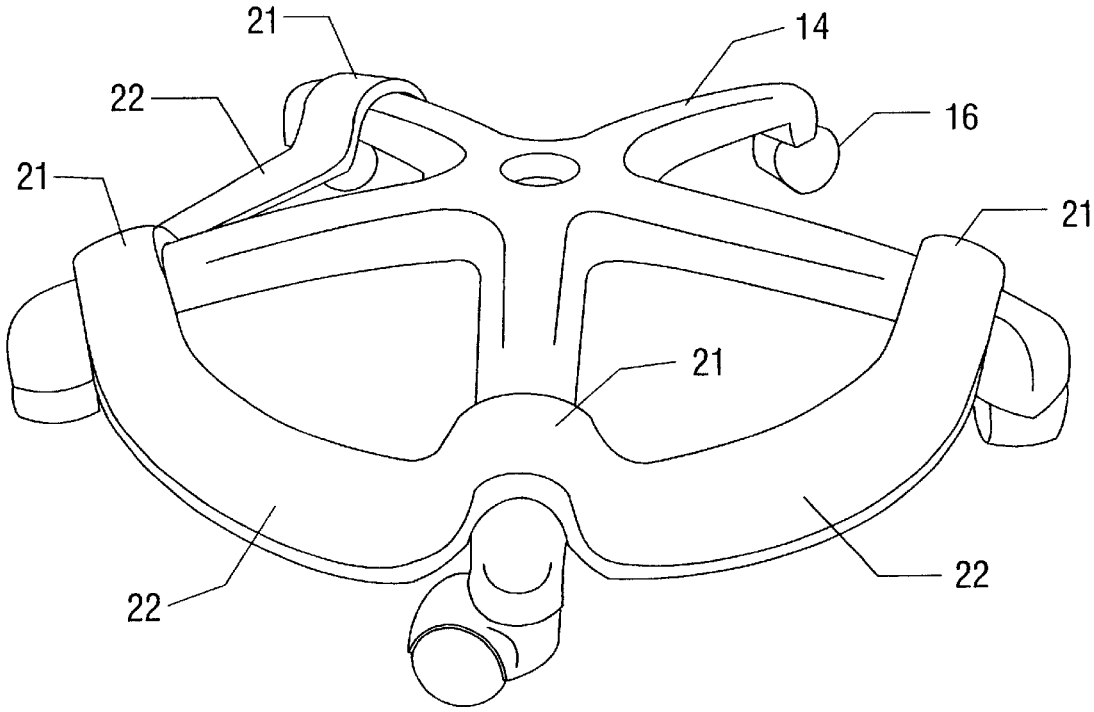
FIG. 2B shows an embodiment of the invention.

Referring to FIG. 2B another embodiment of the present invention is shown in which the footrest apparatus 23 is comprised of three support sections 22 and four connecting sections 21.

In FIG. 2A, while two of the areas between adjacent chair legs 14 have the footrest apparatus, three of the areas between chair legs 14 do not have footrests. Again in this versatile way, the same chair may be utilized by a person wanting footrests, or alternatively, the chair could be rotated so that it might be used without the footrests.

Figure 2C:
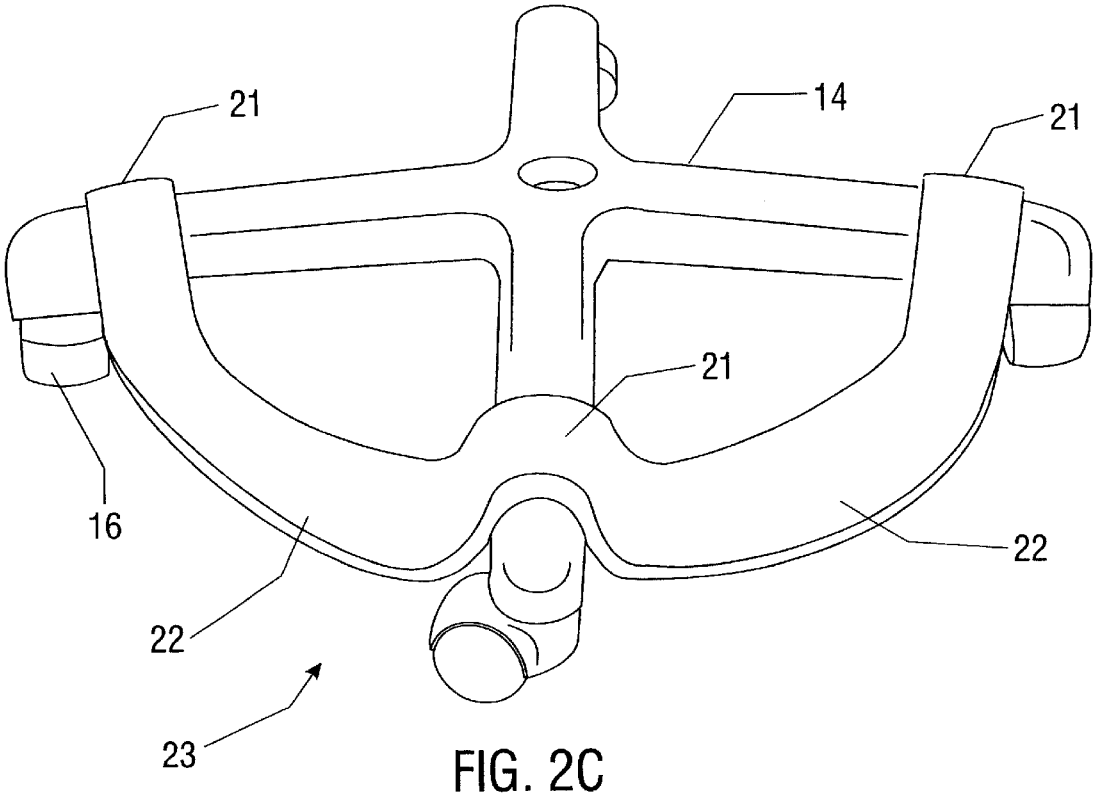
FIG. 2C shows an embodiment of the invention.

FIG. 2C shows another embodiment of the invention in which the footrest assembly 23 is mounted on a chair with four legs 14. In this embodiment the footrest apparatus 23 is comprised of two support sections 22 and three connecting sections 21.

Figure 2D:
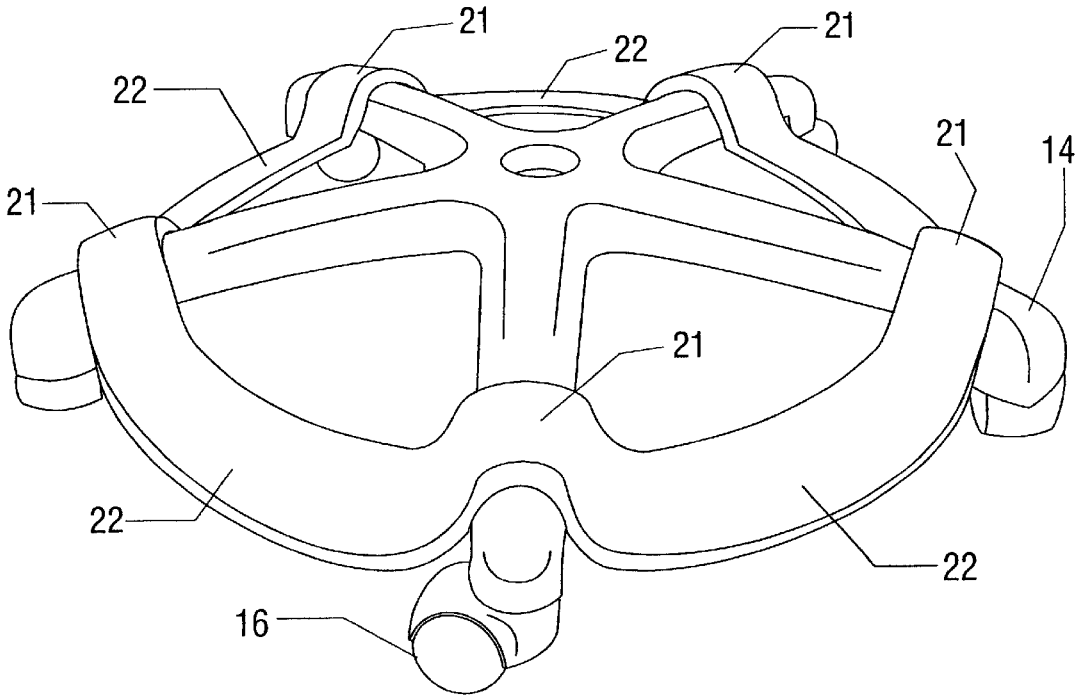
FIG. 2D shows another embodiment of the invention.

Referring to FIG. 2D, another embodiment of the invention is shown in which the footrest totally surrounds the entire chair leg section of the chair. In this embodiment the five support sections 22 in six connecting sections 21 are shown. While in these figures chairs with either four or five legs are shown, some embodiments of the current invention could be utilized with chairs having any number of legs. Further, footrest assembly 23 could be comprised of any number of support sections 22 and connecting sections 21 to attach the footrest apparatus to any number of adjacent chair legs 14.

Figure 3A:
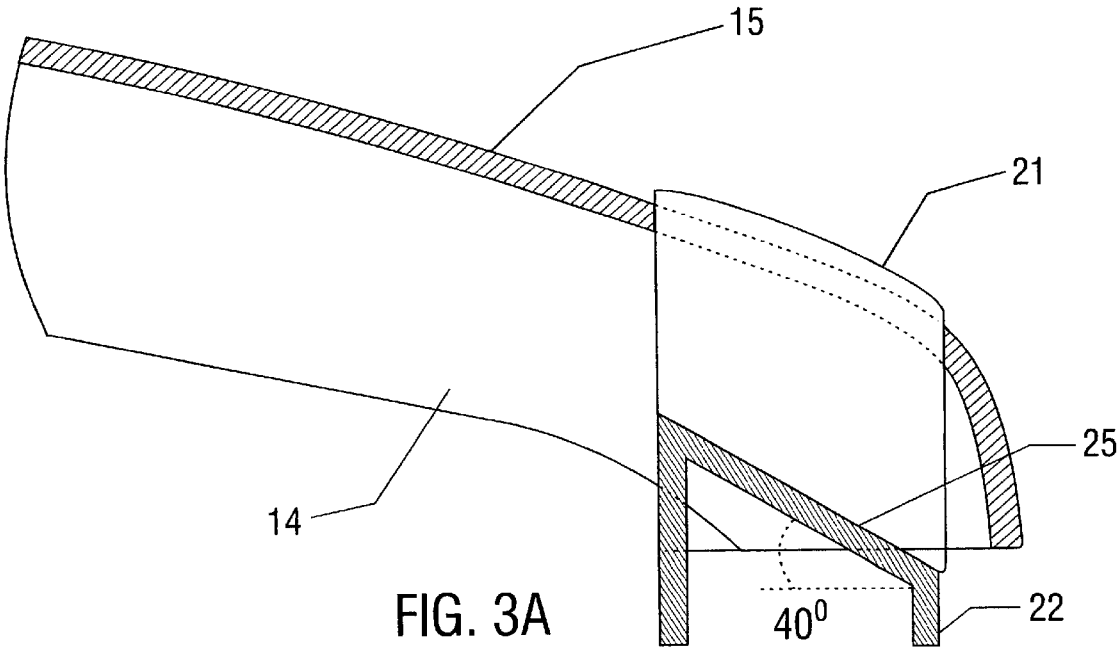
FIG. 3A shows a cross-sectional view of one embodiment of the invention.
Figure 3B:
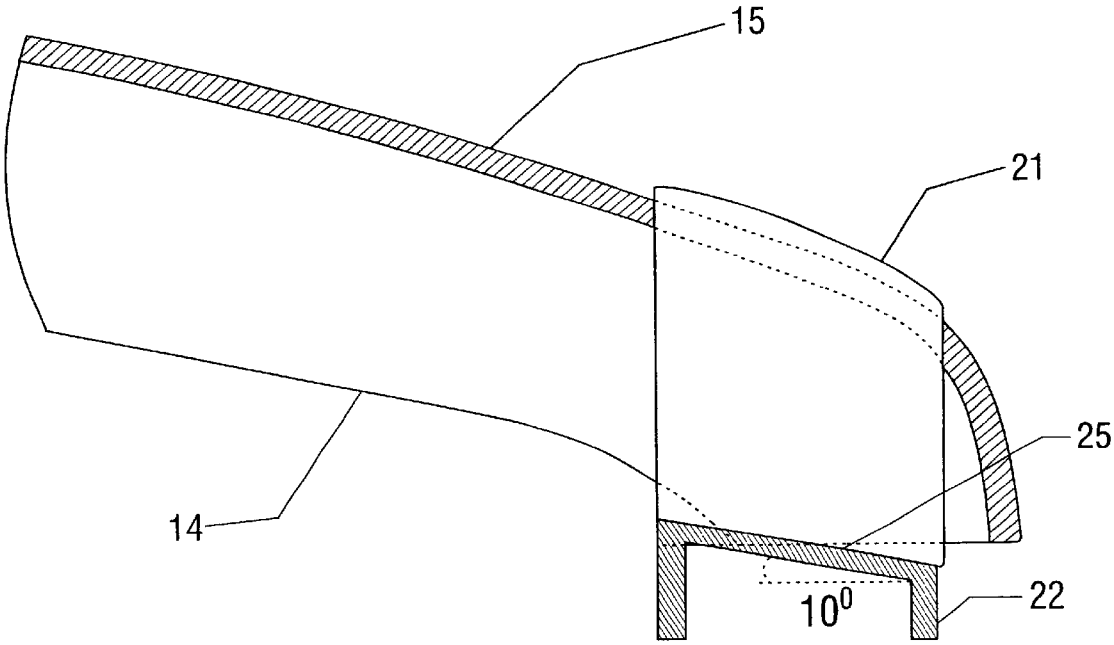
FIG. 3B shows another cross-sectional view of an embodiment of the invention.

FIGS. 3A–3B show a cross-sectional view of embodiments of the present invention. These embodiments show the upper surface 25 of support section 22 to be adapted to receive the bottom surface of a user's feet or footwear. This support section is connected to the substantially horizontally extending chair leg 14 by connecting section 21. Also shown is the upper surface 15 of chair leg 14. In these embodiments of the invention, the upper surface 25 of the support section 22 is closer to the floor than upper surface 15 of chair leg 14. Thus, upper surface 25 of support section 22 is below the upper surface 15 of the substantially horizontal legs. This allows a person to rest his feet in a more comfortable position since the support section 22 is lower to the floor than if the footrest were located above at or above the upper surface of the chair leg.

Upper surface 25 of support section 22 is shown in these embodiments to be angled to the horizontal plane. In FIG. 3A, the angle that the upper surface 25 of support section 22 makes with a horizontal plane is approximately 40 degrees. In FIG. 3B the angle that the upper surface 25 of support section 22 makes with a horizontal plane is approximately 10 degrees. It has been found that by having an angle between 10 and 40 degrees, preferably 30 degrees, the user is more comfortable and less fatigued. More particularly it has been found that fatigue is reduced and circulation is improved with this angled, upper surface 25.

Figure 4A:
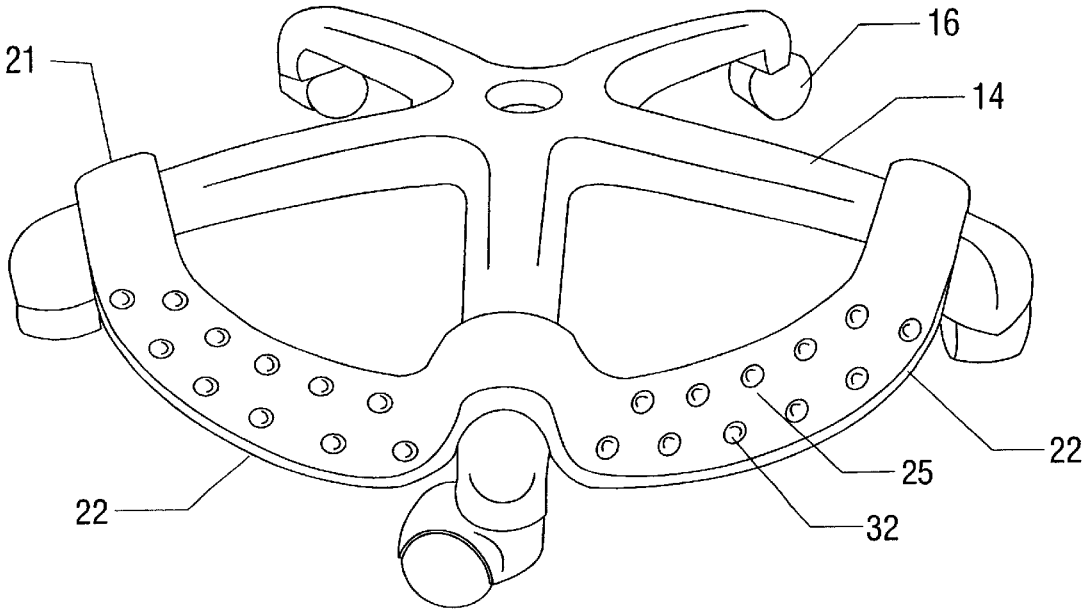
FIG. 4A shows an embodiment of the invention with tactile bumps.
Figure 4B:
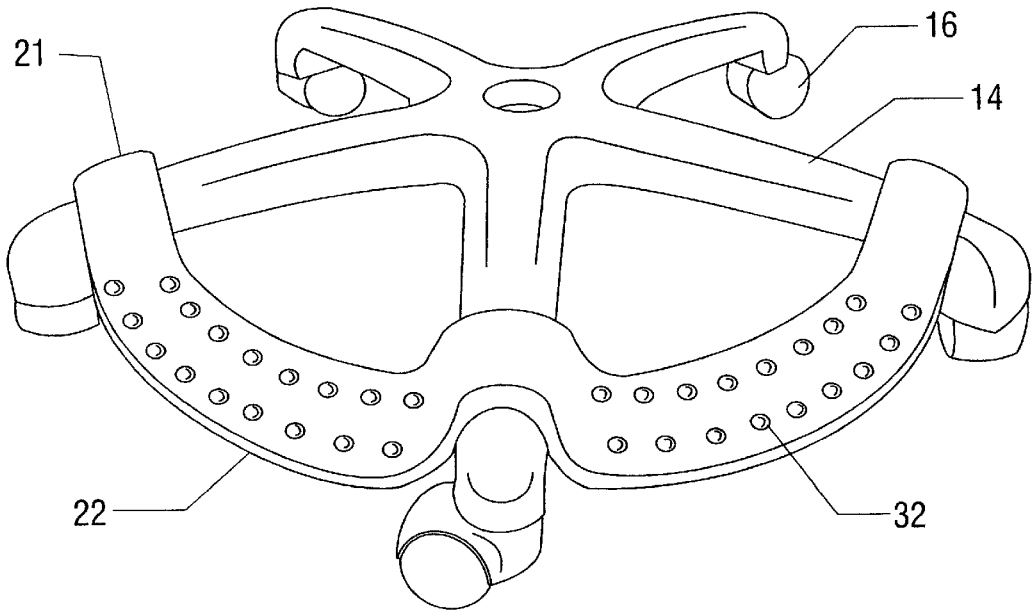
FIG. 4B shows an embodiment of the invention with tactile bumps.

Referring to FIGS. 4A and 4B in these embodiments, upper surface 25 is provided with tactile bumps 32. The tactile bumps are strategically placed along the upper surface 25 of support section 22. Preferably the diameter of these hemispherical tactile bumps is approximately ⅜th inch. In these embodiments, the tactile bumps have been found to be more comfortable and less fatiguing to a seated person than other configurations. Further tactile bumps have been found to retain less unwanted debris from the bottoms of shoes than other traction devices. Preferably the tactile bumps are placed as shown in FIG. 4A: equilateral triangularly spaced with eleven tactile bumps on each support section. However, other configurations, as shown in FIG. 4B, may be utilized.

Figure 4C:
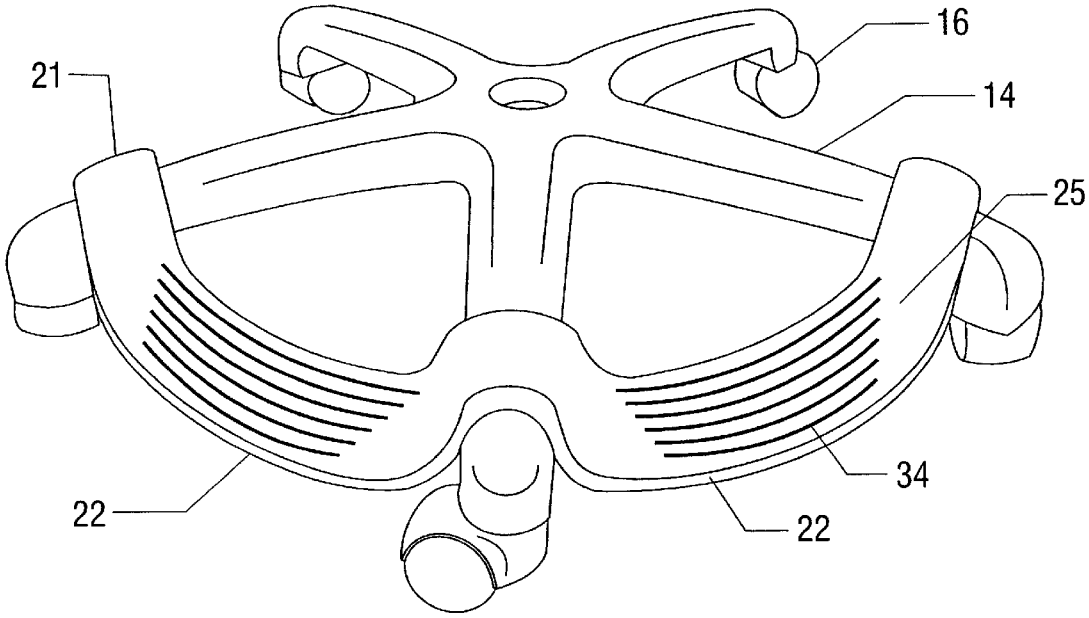
FIG. 4C shows an embodiment of the invention with tactile grooves.

FIG. 4C shows another method of producing traction to hold a user's feet in place: tactile grooves 34. These tactile grooves 34 are made in the upper surface 25 along support section 22.

Figure 3C:
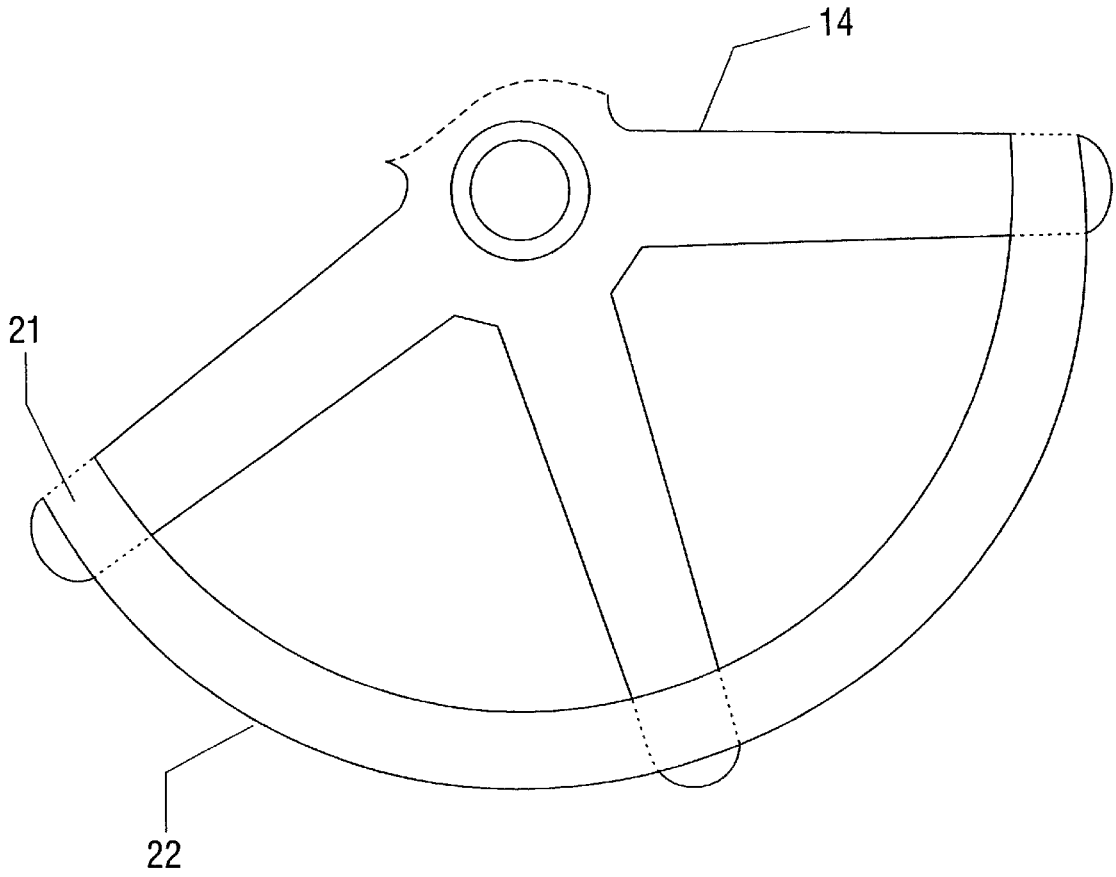
FIG. 3C shows a top view of one embodiment of the invention.
Figure 3D:
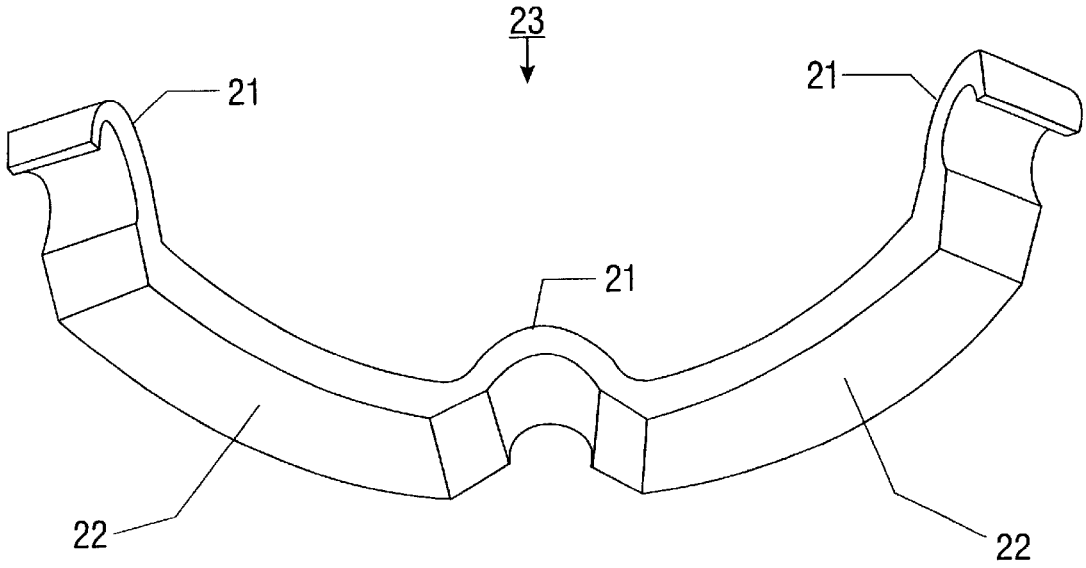
FIG. 3D shows a perspective view of one embodiment of the invention.
Figure 3E:
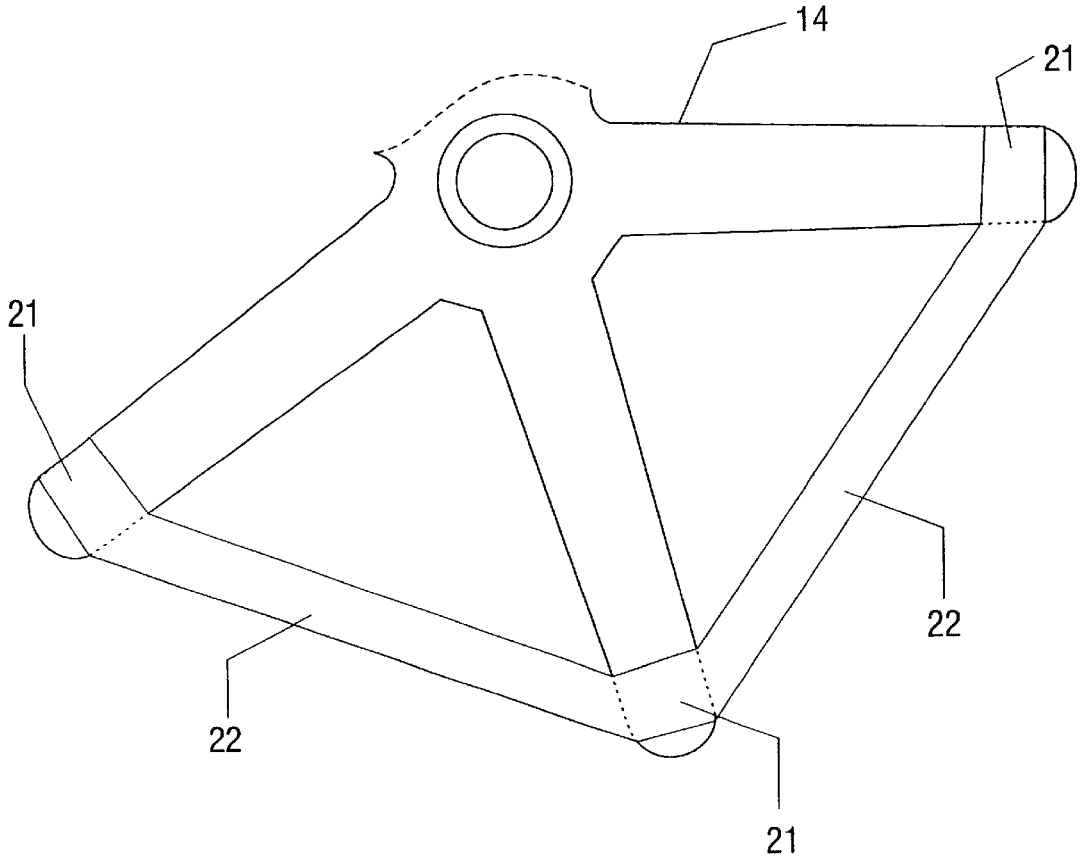
FIG. 3E shows another embodiment of the invention.

Referring to the embodiment shown in FIG. 3C, support section 22 is shown to be substantially curvilinear. In the embodiment shown in FIG. 3E, support section 22 is shown to be linear, not curvilinear. Finally, in FIG. 3D, one embodiment of the footrest apparatus is shown unattached to any chair legs.

Figure 5A:
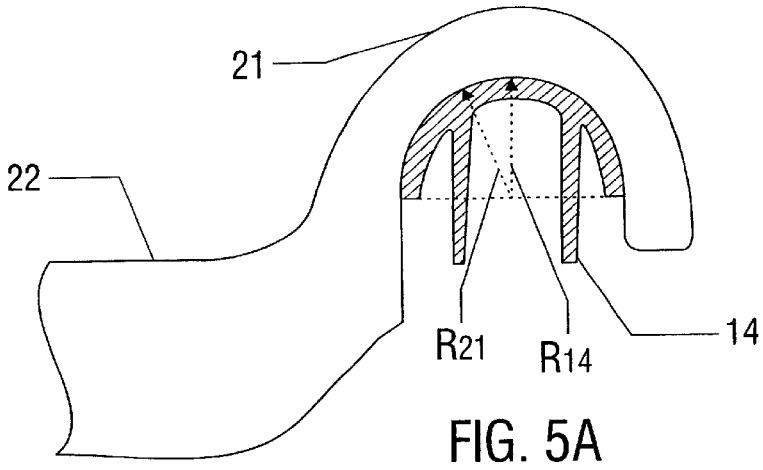
FIG. 5A shows an embodiment of the invention.

Referring to FIGS. 5A–5E, the connecting section 21 is attached to chair leg 14 as illustrated. In FIG. 5A, chair leg 14 has an outer radius of $R_{14}$. Similarly connecting section 21 has an inner radius of $R_{21}$. As shown in FIG. 5A, preferably $R_{21}$ is approximately equal to $R_{14}$. Therefore, connecting section 21 is attached to chair leg 14 by this concentric snap fit. Thus, footrest apparatus 23 may be easily attached and detached to chair legs 14.

Figure 5B:
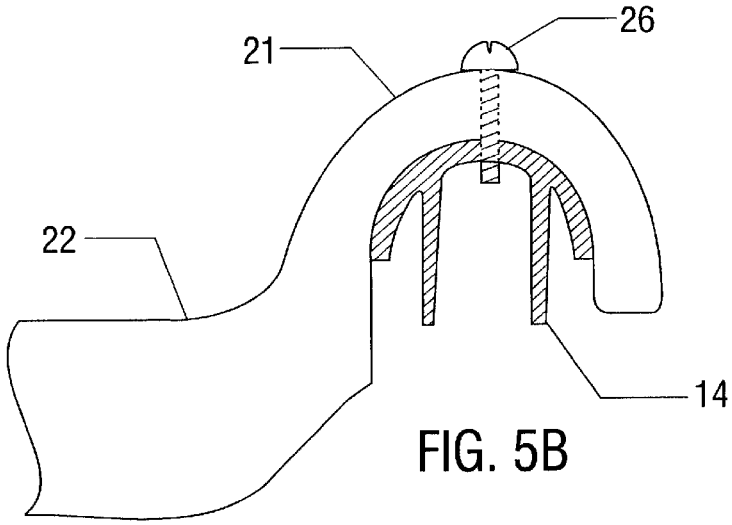
FIG. 5B shows an embodiment in which the fastener is a screw.
Figure 5C:
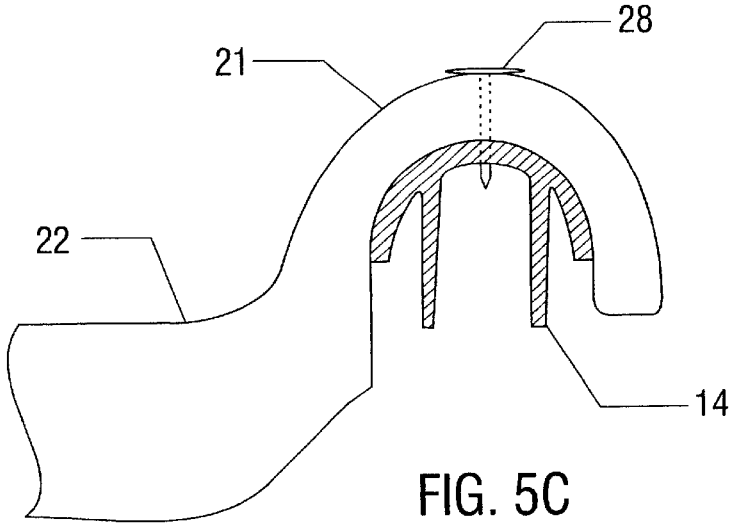
FIG. 5C shows an embodiment in which the fastener is a nail.
Figure 5D:
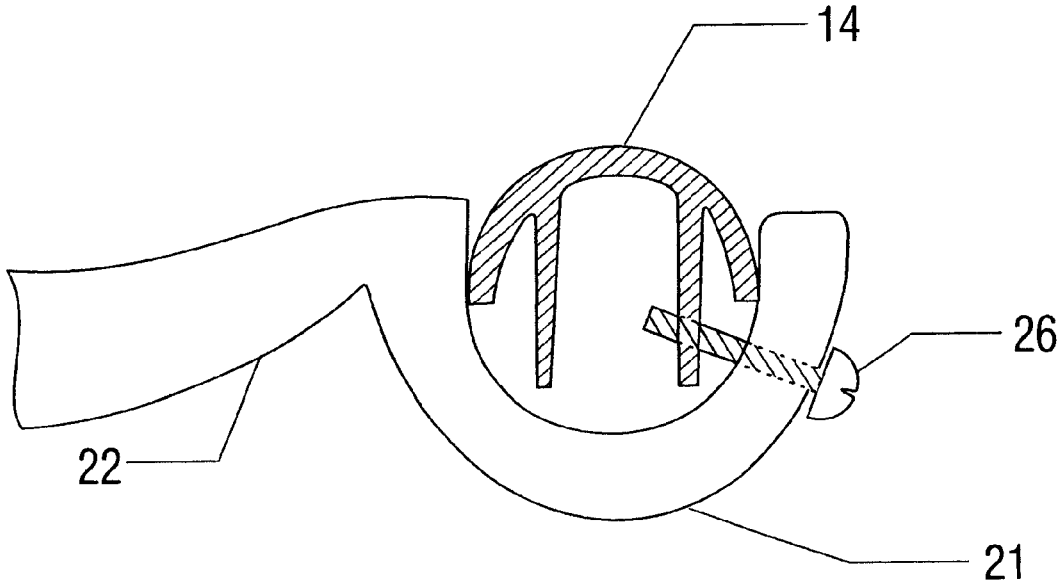
FIG. 5D shows an embodiment in which the fastener is inverted.
Figure 5E:
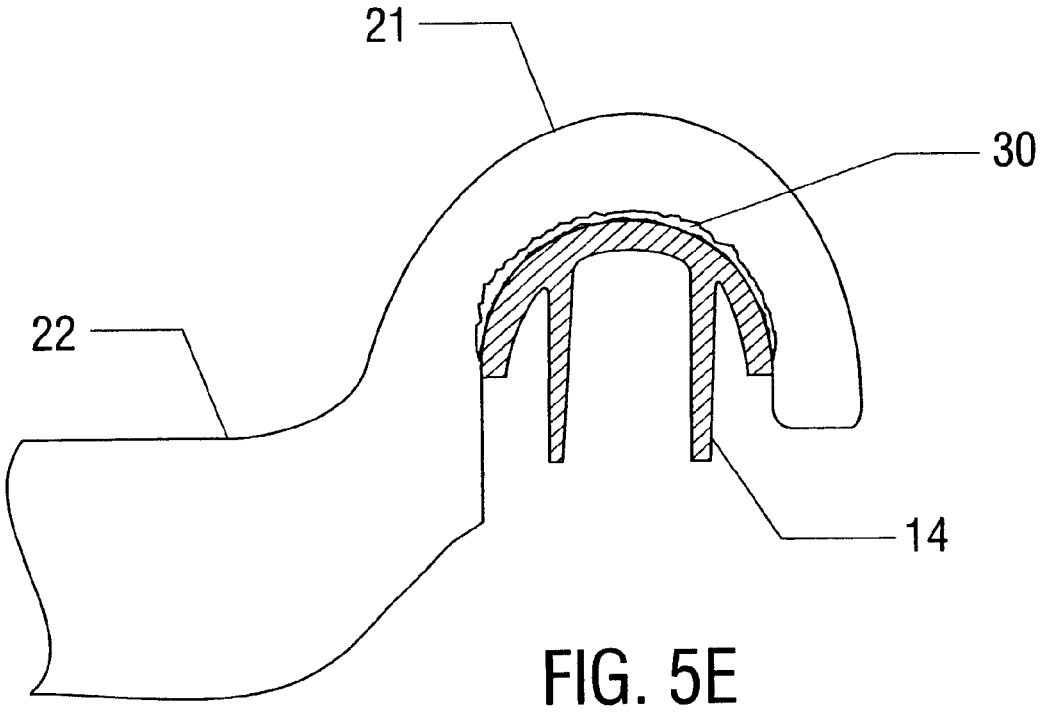
FIG. 5E shows an embodiment in which the fastener is glue.

In FIG. 5B, a screw 26 is used to fasten connecting section 21 to chair leg 14. In FIG. 5C, a nail 28 is used to attach connecting section 21 to chair leg 14. In FIG. 5D, again a screw 26 is used to connecting section 21 to chair leg 14. However, the connecting section in FIG. 5D is inverted. Thus, footrest apparatus 23 may be attached to chair legs 14 in many ways. Finally in FIG. 5E, glue 30 is used to attach connecting section 21 to chair leg 14.

In some embodiments, the footrest apparatus 23—comprised of the support sections 22 and connecting sections 21—is preferably formed of a suitable material, such as injection-molded plastic.

Figure 6:
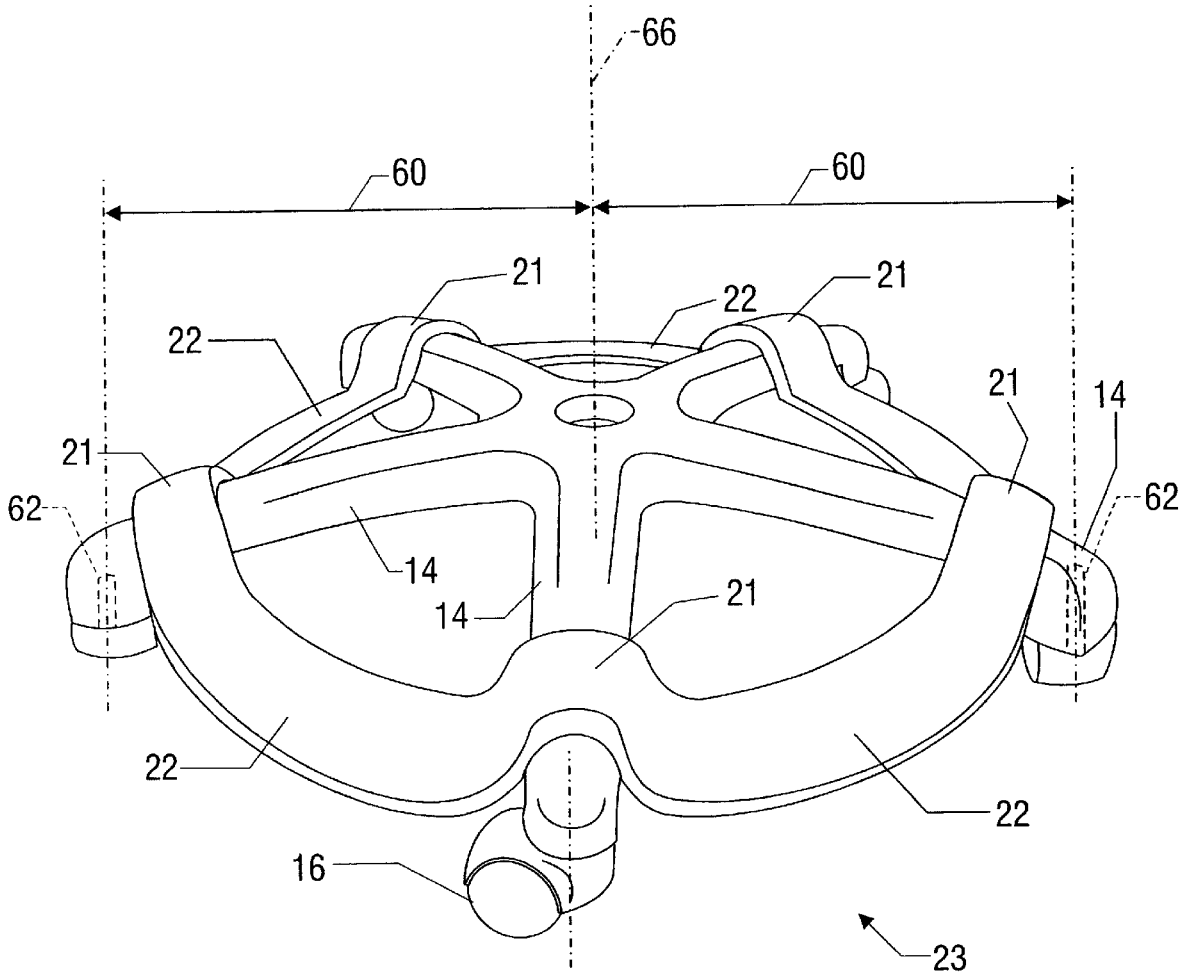
FIG. 6 shows a definition of the length of a chair leg.

Referring to FIG. 6, the footrest apparatus 23 is shown mounted on a chair base having five horizontally-extending chair legs 14. As shown, the castors 16 are attached to the substantially horizontally-extending chair legs 14 by castor posts 62. Also shown is an axis corresponding to the center of the chair 66 which aligns with the center of the chair support column (not shown, 18 in FIGS. 1 and 2). Chair leg length 60 may be defined as the distance between the vertical axis of a castor post 62 and the vertical axis of the center of the chair 66. Industry-standard sizes of chairs have chair leg lengths of approximately 23 inches, 25 inches, or 27 inches. However, other sizes of chairs having other chair leg lengths are available.

Figure 7A:
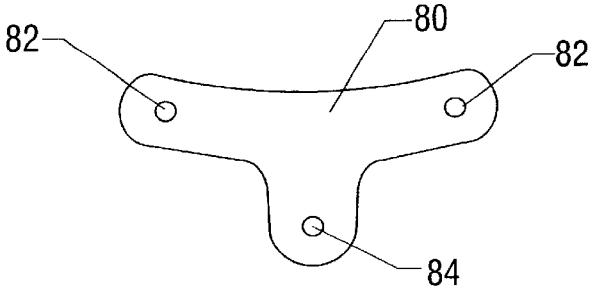
FIGS. 7A–7F show an embodiment of the present invention that is adjustable for differing lengths of chair legs.
Figure 7B:
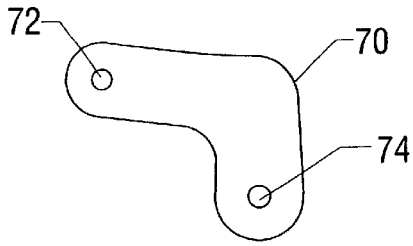

Referring to FIG. 7A, a connector is shown as a T-segment 80. T-segment 80 contains two holes 82 and one post hole 84. Referring to FIG. 7B, the connector is shown to be an L-segment 70. L-segment 70 has a hole 72 and a post hole 74. In these embodiments, the connector may be a T-segment 80, an L-segment 70, or any other shaped connector that could be utilized as described herein.

Figure 7C:
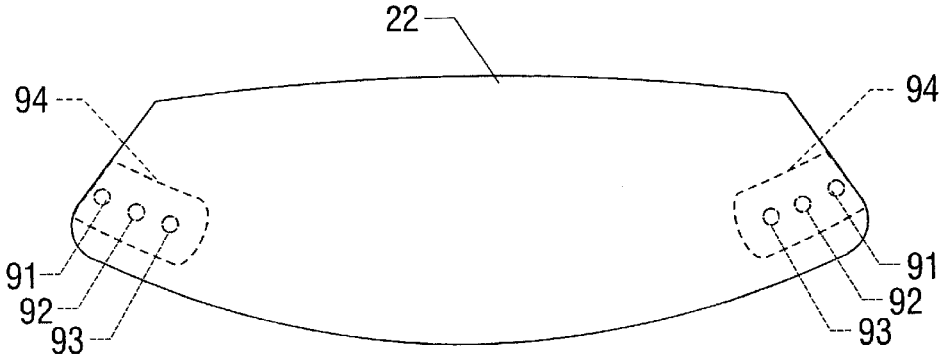
Figure 7D:
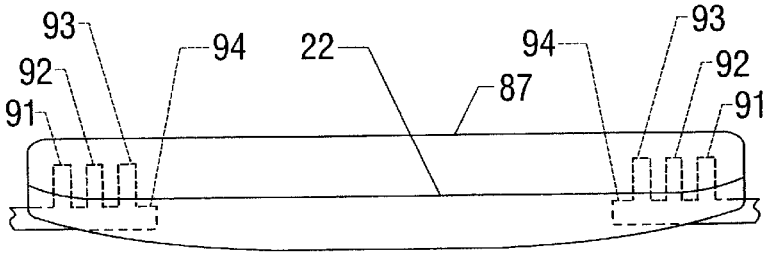
Figure 7E:
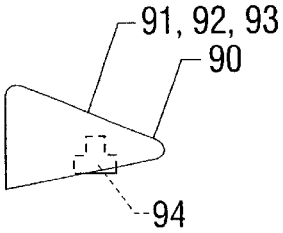

Referring to FIG. 7C, a support section 22 is shown having two slots 94 on each end of the support section 22. Within each slot 94 are a first hole 91, a second hole 92, and a third hole 93. Referring to FIG. 7D, a side view of the support section 22 is shown. In these embodiments, holes 91, 92, and 93 do not extend through an upper surface 87 of the support section 22. An end view of the support section 22 is shown in FIG. 7E.

Figure 7F:
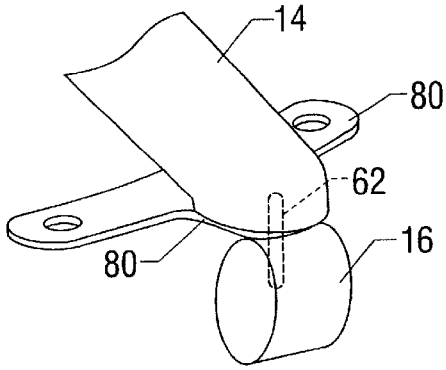
Figure 8A:
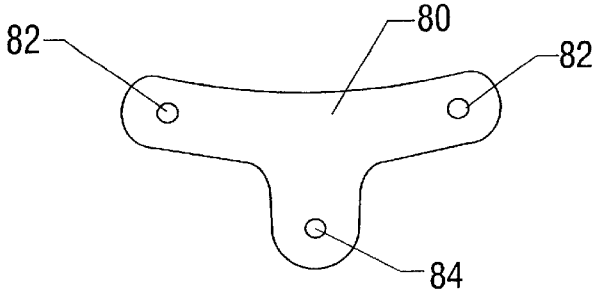
FIGS. 8A–8F another embodiment of the present invention that is adjustable for differing lengths of chair legs.
Figure 8B:
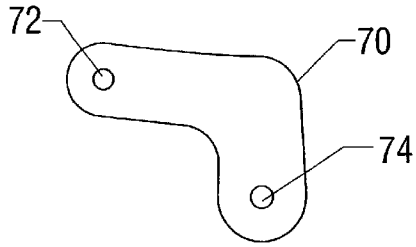
Figure 8C:
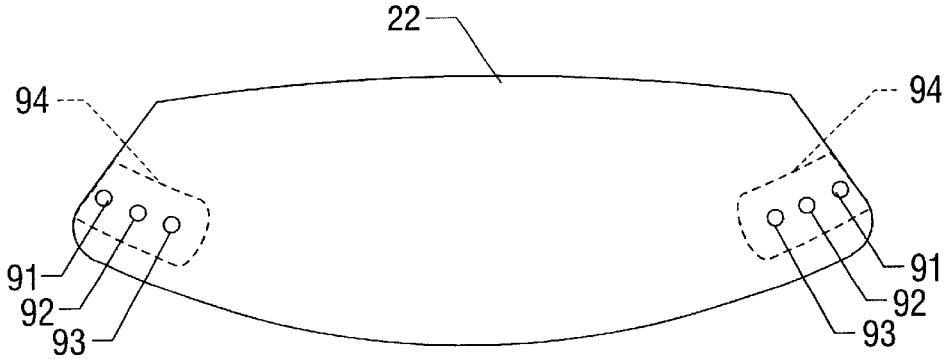
Figure 8D:
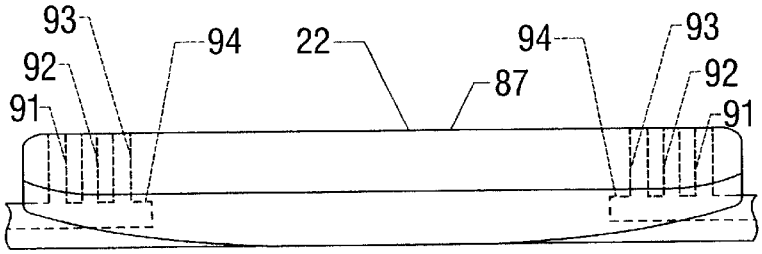
Figure 8E:
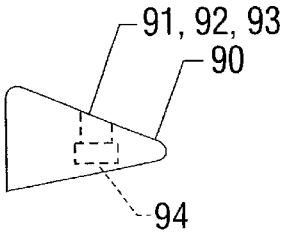
Figure 8F:
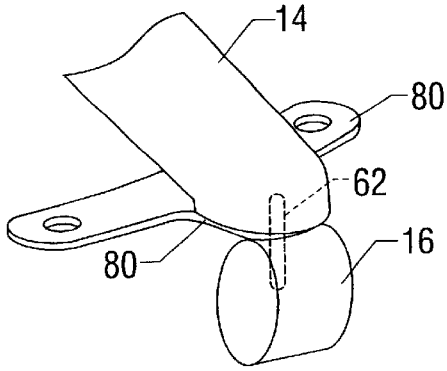

In FIG. 7F, the connector, here a T-segment 80, is shown mounted between the castor 16 and the substantially horizontally-extending chair leg 14. Caster 16 is attached to caster post 62. Caster post 62 runs through post hole 84 of T-segment 80, thus sandwiching the T-segment 80 between the caster 16 and the substantially horizontally-extending chair leg 14.

Another embodiment of the present invention is shown in FIG. 8. This embodiment is similar to that embodiment shown in FIGS. 7A–7F with the following exception: The holes 91, 92, and 93 in the support section 22 extend through the top surface 87 of the support section 22.

Figure 9A:
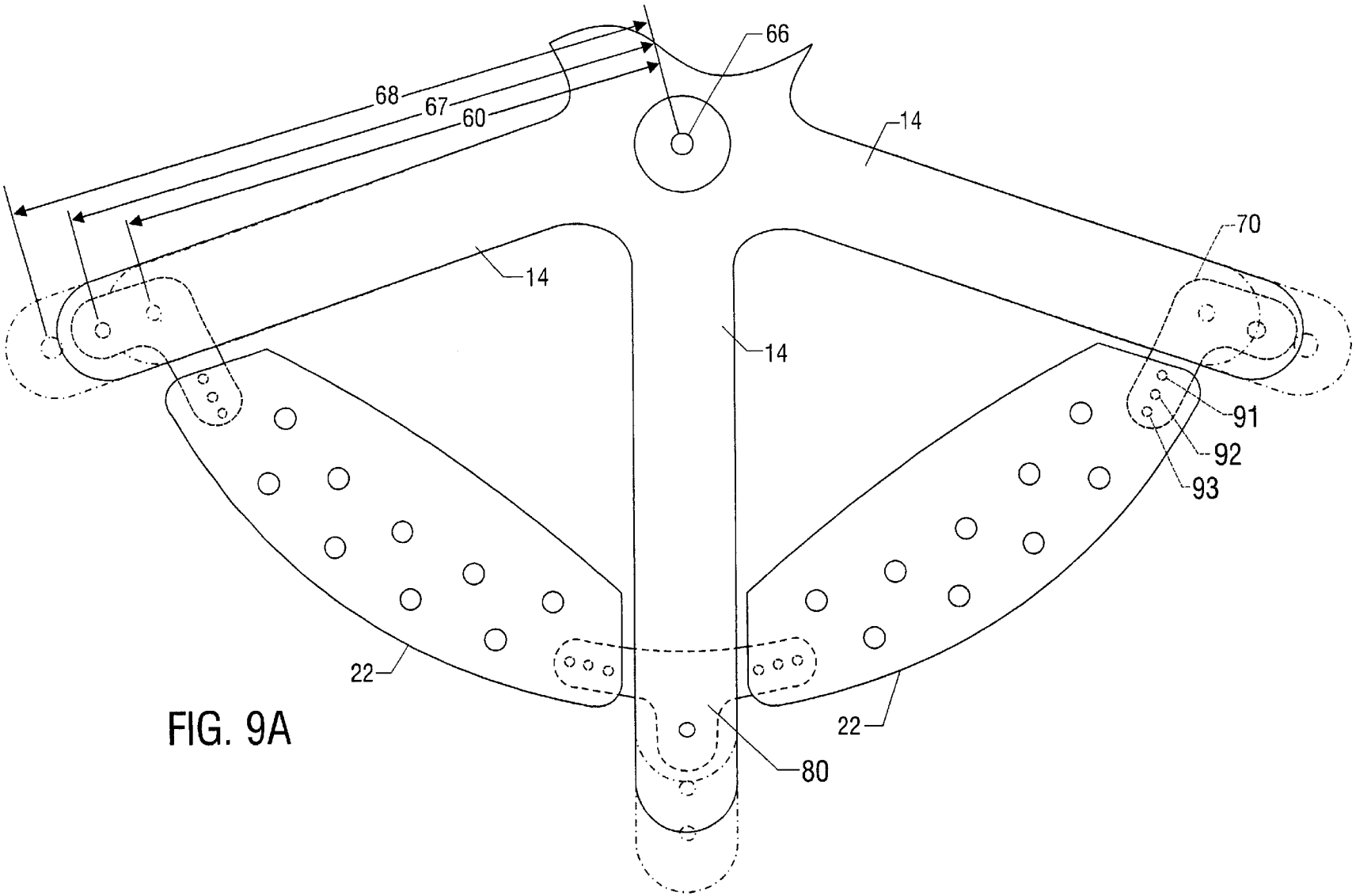
FIGS. 9A–9D show an embodiment of the present invention in which a support section is attached to chair legs.

Referring to FIG. 9A, another embodiment of the present invention is shown. A first chair length 60 is shown to be defined by the distance between the center of caster post 62 and center of the chair 66. Superimposed on this distance 60 is a second chair length 67 followed by a third chair length 68. In practice, first chair length 60 could be 23 inches for example, second chair leg length 67 could correspond to a chair leg length of 25 inches for example, and third chair leg length 68 could correspond to a chair leg length of 27 inches.

In these embodiments, two support sections 22 are shown. Each support section 22 is attached to substantially horizontally-extending legs 14 by an adjustable element on each end of the support section 22. For instance, the right end of the support section 22 shown on the right side of FIG. 9A is attached to the substantially horizontally-extending chair legs 14 as follows: The connector—here, L-segment 70—is sandwiched between casters 16 and substantially horizontally-extending leg 14 as previously described. The caster post 62 passes through the caster post hole 74 in the L-segment 70. The other end of the L-segment 70 (i.e. the end having holes 91, 92, and 93) is inserted into the slot 94 in the support section 22. The adjustable element is defined by connecting the support section 22 to the connector, here the L-segment 70.

A bolt 64 or any other connection means (not shown) passes through one of the holes 91, 92, or 93 in support section 22. The bolt 64 also passes through the hole 70 to an L-segment in L-segment 70. This connection forms an adjustment element because holes 91, 92 or 93 can be utilized to the secure support section 22 to the chair leg 14. In this way, the first end of the support section 22 is adjustably, removable attached to chair leg 14.

The second end of the same support section 22 is connected to another substantially horizontally-extending leg 14 by a connector—shown as T-segment 80. The T-segment 80 fits into the slot 94 of the second end of the support section 22. A second adjustable element is formed by passing a bolt 64 through either hole 91, 92 or 93 in the support section 22. Bolt 64 also passes through hole 82 in the connector, here the T-segment 80. Thus, this adjustable element may be used to adjustably, removably attaching the support section 22 to the substantially horizontally-extending leg 14.

The second support section 22 shown in the left side of the FIG. 9A may be attached in a similar fashion. Of course, any other type of connecting means besides a bolt could be utilized.

Figure 9B:
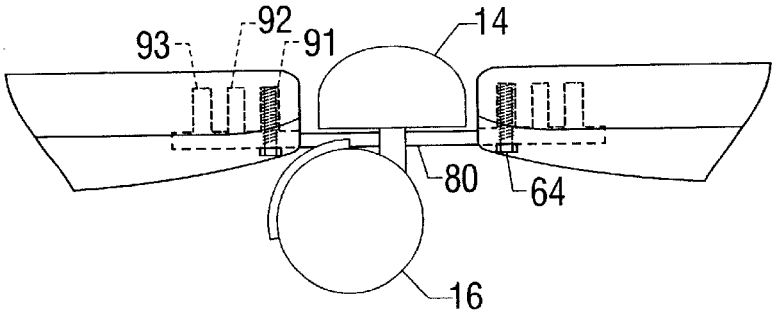
Figure 9C:
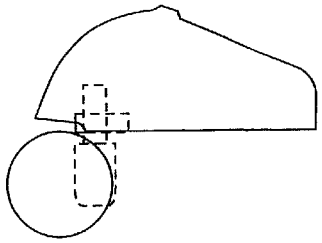
Figure 9D:
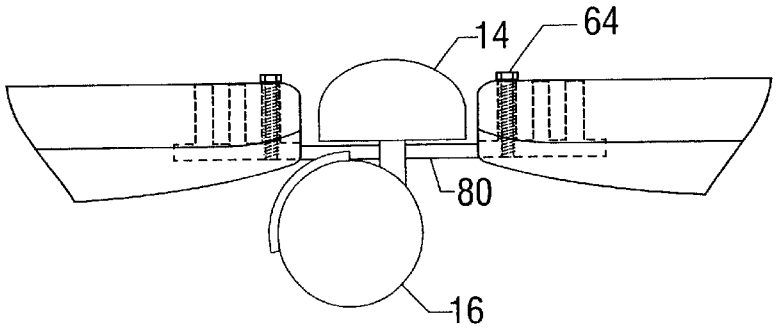

In FIG. 9B, an adjustable element is shown to be defined by bolt 64 being inserted into one of the holes 91 from the bottom of the support section 22 through a connector, here T-segment 80. FIG. 9C shows a side view of this adjustable element. FIG. 9D shows another configuration of the adjustable element. In this embodiment, bolt 64 is inserted from the top side of support section 22 through a hole 91 in support 90 and into a connector, T-segment 80 via a hole 82. In these embodiments, holes 91, 92, and/or 93 may be threaded to receive the bolt 64 or other connection means.

Figure 10A:
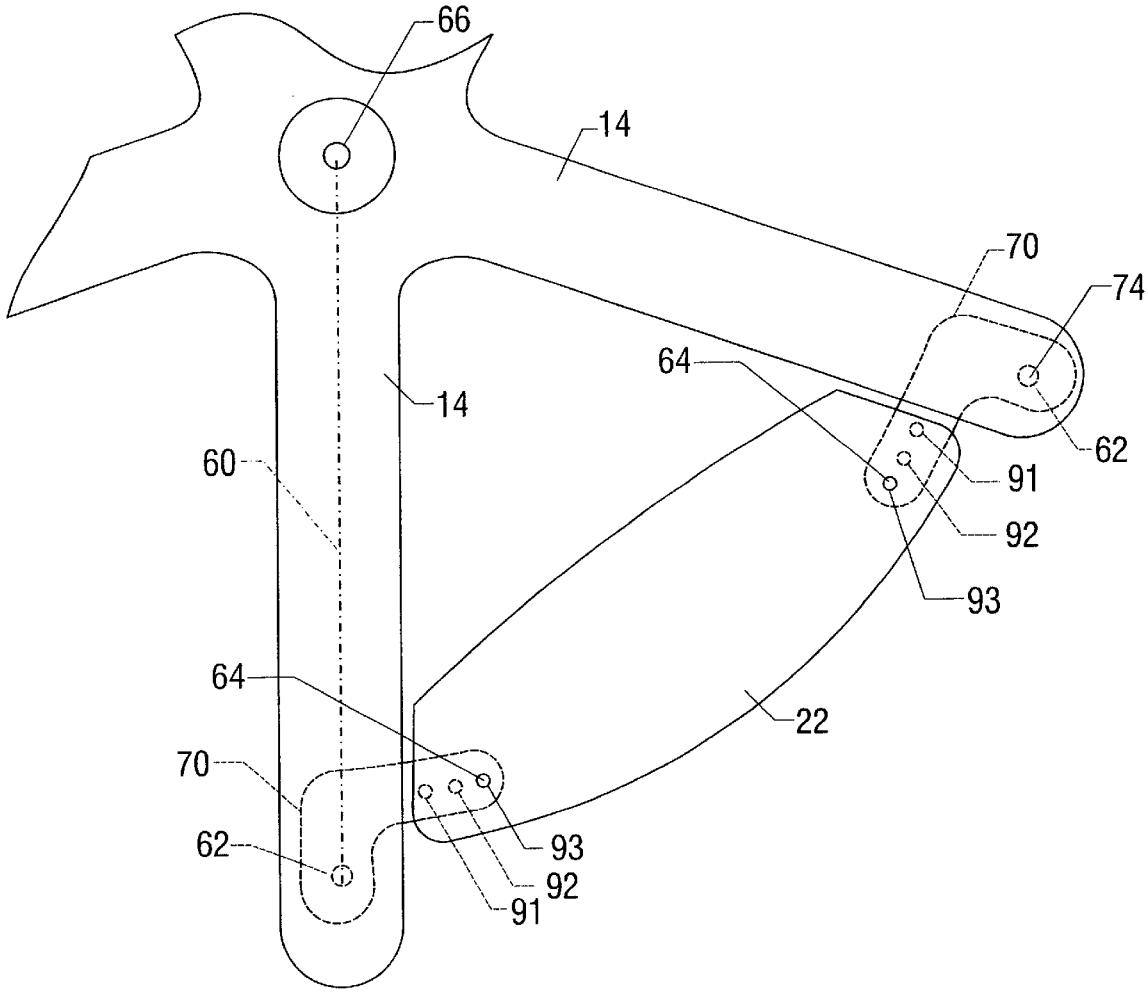
FIGS. 10A–10C show an embodiment of the present invention having one support section being attached to different lengths of chair legs.
Figure 10B:
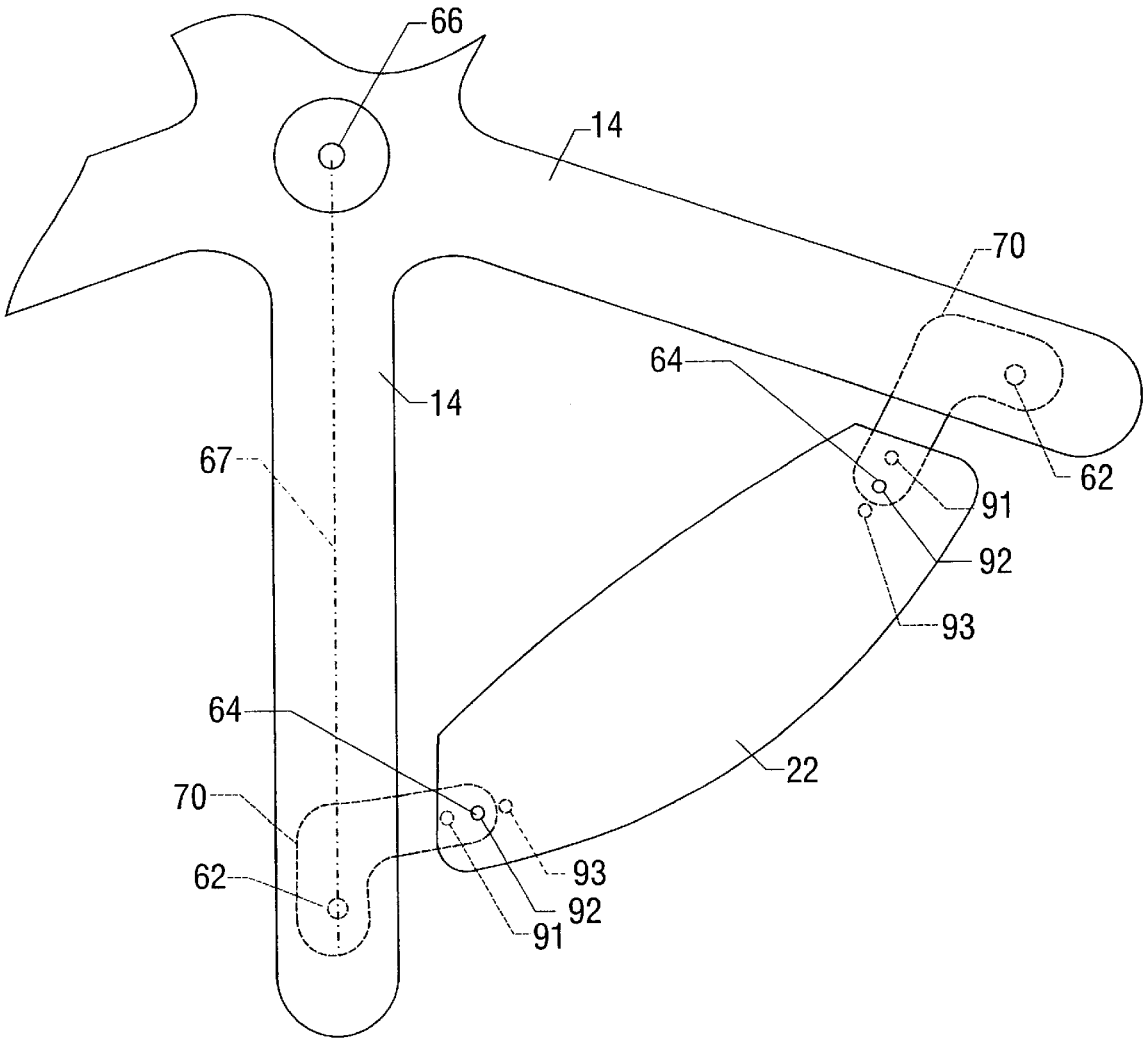
Figure 10C:
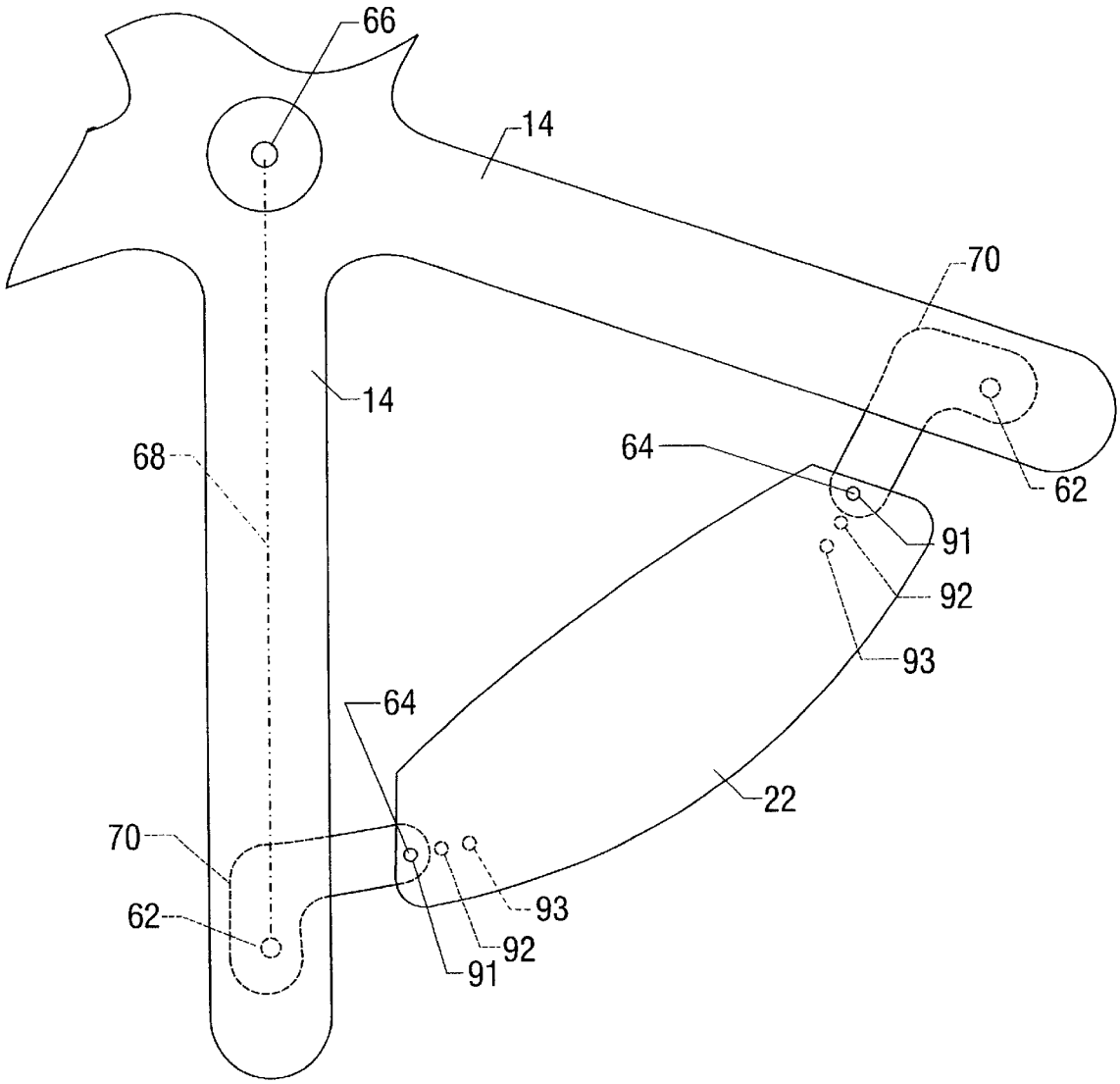

Referring to FIGS. 10A–C, an embodiment of the present invention is shown in which the footrest is progressively attached to three different sizes of chairs: a chair having a first chair leg length 60 (e.g. 23 inches) in FIG. 10A, a second chair leg length 67 (e.g. 25 inches) in FIG. 10B, and a third chair leg length 68 (e.g. 27 inches) in FIG. 10C.

In the embodiments shown, one support section 22 is shown. The connectors are shown to be L-segments 70. As described previously, L-segments 70 are sandwiched between the caster 16 and the substantially horizontally-extending chair leg 14 by castor post 62 passing through post hole 74 in L-segment 70. Other connectors, e.g. T-segments, could be employed.

Each end of the support section 22 is connected to the substantially horizontally-extending legs 14 by an adjustable element. For example, the first end of the support section 22 is connected via an adjustable element to a first connector, in this case the L-segment 70 described previously. The L-segment 70 is adapted to be received within slot 94 on the first end of the support section 22. The adjustable element is shown to be defined the bolt 64 passing through the hole 91 of support section 22, and attached to the L-segment 70 via the hole 72, which may be threaded. Alternatively, the bolt 64 could be inserted from the underside of the support section 22, passing through the hole 72 in the L-segment 70, and embedded into the support section 22.

In this example, the first chair leg length 60 is the shortest of the three chair lengths. Therefore, the bolt 64 is attached to the inner-most hole 93 on the end of the support section 22.

Referring to FIG. 10B, the support section 22 is shown attached to a different size of chair: one having a legs corresponding to second chair leg length 67, e.g. 25 inches. To accommodate the longer leg length, the adjustable element is formed by utilizing hole 92, instead of hole 93, in support section 22. As described above, the bolt 64 passes through the hole 92 to be inserted into a threaded hole 72 of the L-segment 70. Referring to FIG. 10C, the support section 22 is shown attached to the chair having the longest leg length 68 (e.g., 27 inches). To accommodate this longest leg length, the adjustable element is formed by utilizing outer-most hole 93, instead of the hole 92, in the support section 22. As described above, the bolt 64 passes through the hole 93 and is inserted into a threaded hole 72 of L-segment 70.

Of course in these embodiments, the T-segment 80 could be substituted for the L-segment 70. Further, any number of T-segments 80 and L-segments 70 could be utilized with a corresponding number of support sections 22 to provide the desired number of support sections 22 attached to substantially horizontally-extending legs. Further, as with the previous embodiments of the footrest, the support section 22 may be angled as shown in FIGS. 3A and 3B, e.g. to 30° from the horizontal. Further, the support section may have grooves or tactile bumps on its upper surface as shown in FIGS. 4A, 4B, and 4C.

Figure 11A:
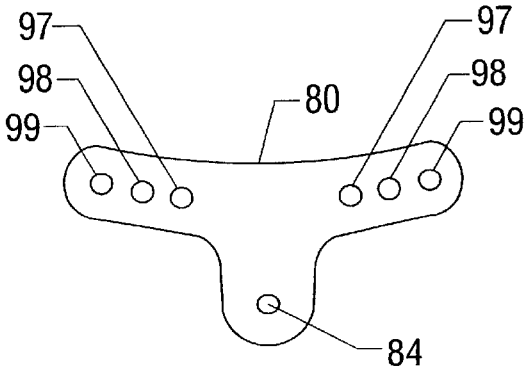
FIGS. 11A–11C show an adjustable embodiment of the present invention having multiple holes on the T-segment and the L-segment.

These adjustable elements are not limited to being defined by connecting the support section 22 to the substantially horizontally-extending legs, the support section having just three holes placed on the end of the support section 22. Any number of holes, slots, or other equivalents could be utilized to provide the adjustable connection. For example, the support section 22 could contain only one hole, while the connectors could contain multiple holes to allow adjustment. As shown in FIGS. 11A, the T-segment 70 could contain a post hole 84 as well as the other holes 97, 98, and 99 as shown. Further, the L-segment 70 could contain post hole 74 as well as the other holes 97, 98, and 99. The support section 22 could contain only one hole 92 on each end. Slots 94 are adapted to receive the connectors as described herein.

The adjustable element is formed by again utilizing bolt 64 or any other connection means passing through the hole 95 in the support section 22, and through one of the holes 97, 98, or 99 in the connectors. By alignment of the hole 95 in support section 22 with the different holes 97, 98, or 99, the same footrest support section can be utilized with different sizes of chairs, i.e. chairs with different leg lengths.

Figure 12A:
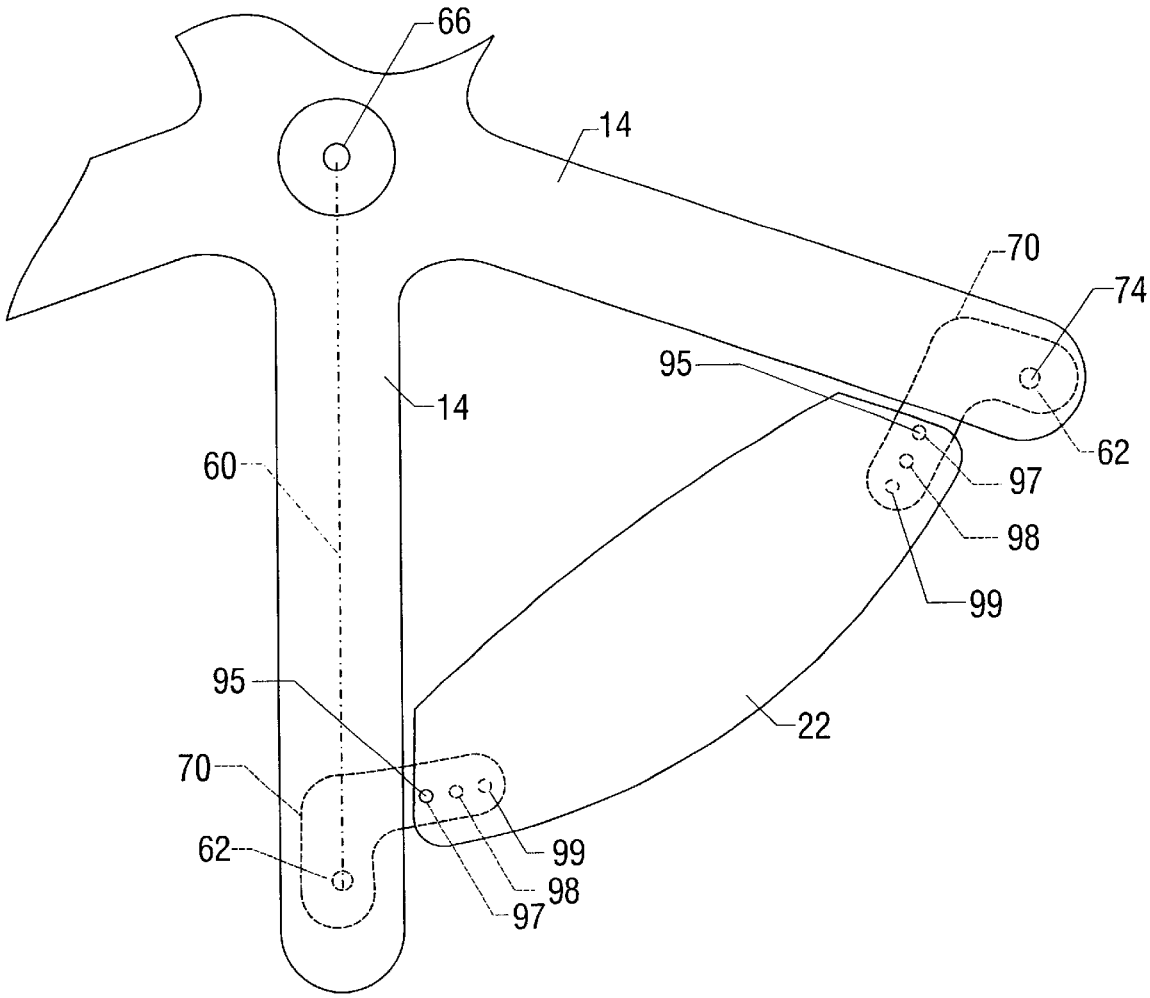
FIGS. 12A–12C shown an embodiment of the present invention being attached to chairs of different sizes.
Figure 12B:
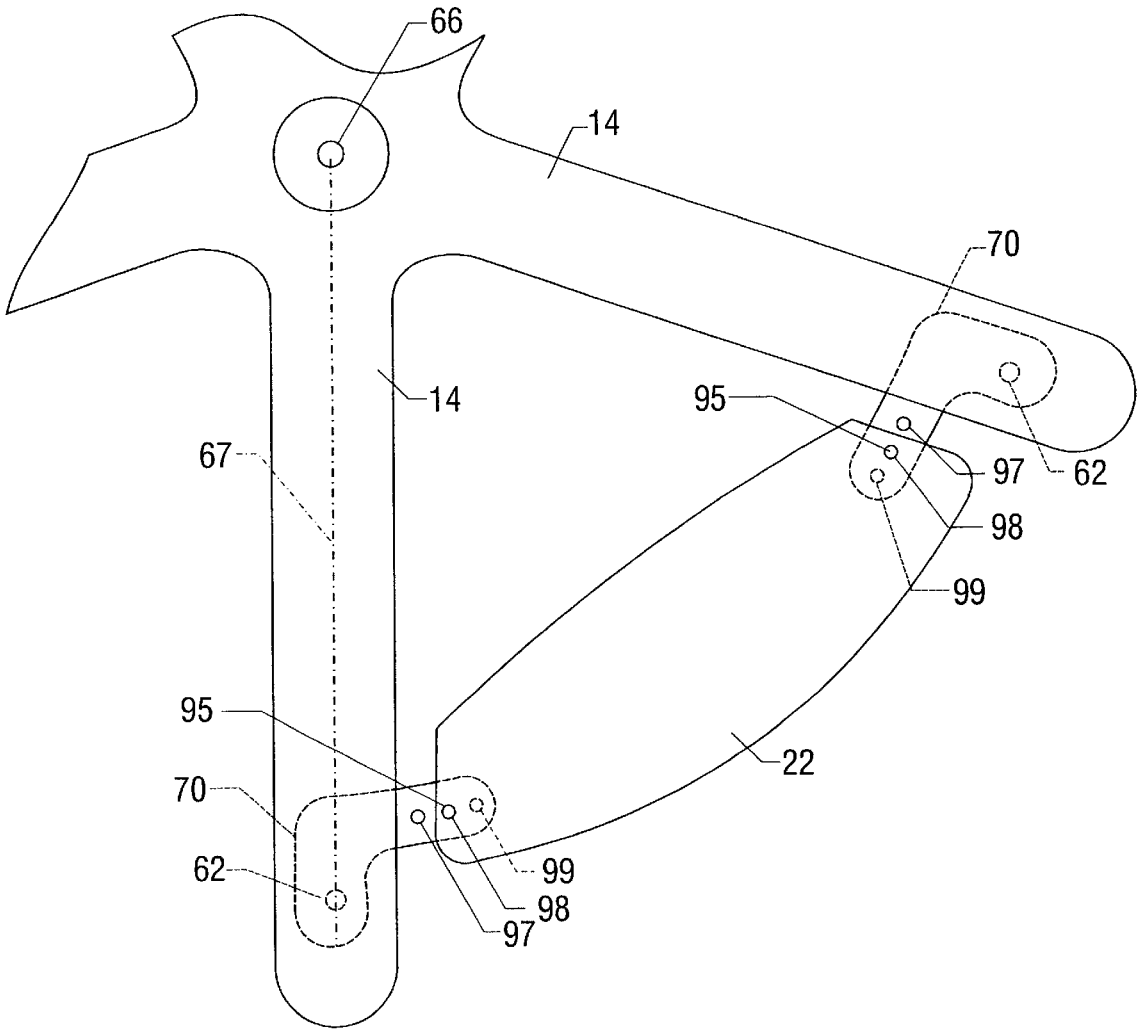
Figure 12C:
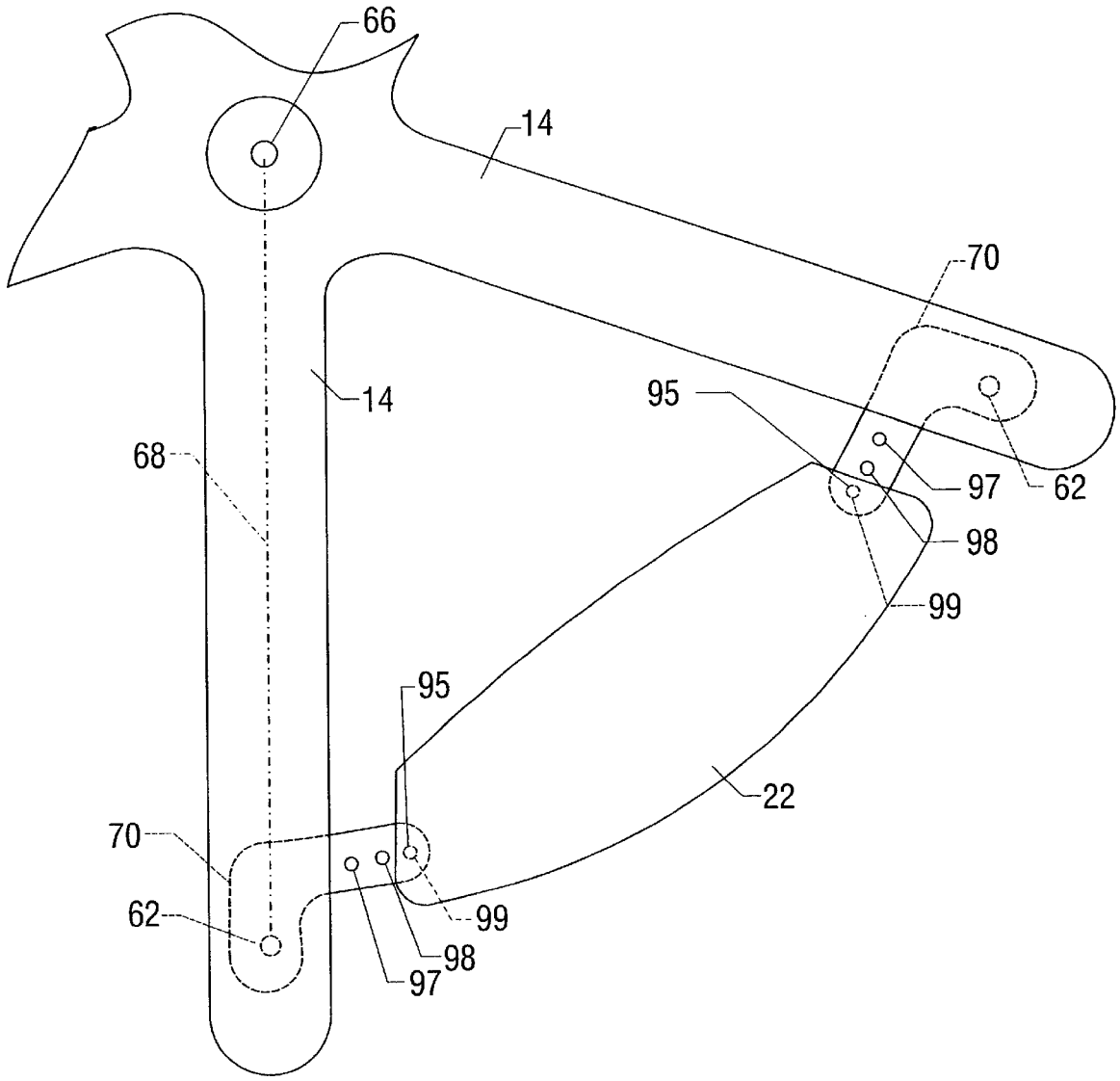

Referring to FIGS. 12A–C, an embodiment of the present invention is shown in which the footrest is progressively attached to three different sizes of chairs: a chair having a first chair leg length 60 (e.g. 23 inches) in FIG. 12A, a second chair leg is length 67 (e.g. 25 inches) in FIG. 12B, and a third chair leg length 68 (e.g. 27 inches) in FIG. 12C.

In the embodiments shown, one support section 22 is shown. The connectors are shown to be L-segments 70. As described previously, L-segments 70 are sandwiched between the caster 16 and the substantially horizontally-extending chair leg 14 by castor post 62 passing through post hole 74 in L-segment 70. Other connectors, e.g. T-segments, could be employed.

Each end of the support section 22 is connected to the substantially horizontally-extending legs 14 by an adjustable element. For example, the first end of the support section 22 is connected via an adjustable element to a first connector, in this case the L-segment 70 described previously. The L-segment 70 is adapted to be received within slot 94 on the first end of the support section 22. The adjustable element is shown to be defined the bolt 64 passing through the hole 95 of support section 22, and attached to the L-segment 70 via the hole 99, which may be threaded. Alternatively, the bolt 64 could be inserted from the underside of the support section 22, passing through the hole 99 in the L-segment 70, and connected to the support section 22.

In this example, the first chair leg length 60 is the shortest of the three chair lengths. Therefore, the bolt 64 is attached to the outer-most hole 99 on the end of the L-segment 70.

Referring to FIG. 12B, the support section 22 is shown attached to a different size of chair: one having a legs corresponding to second chair leg length 67, e.g. 25 inches. To accommodate the longer leg length, the adjustable element is formed by utilizing hole 98, instead of hole 99, in L-segment 70. As described above, the bolt 64 passes through the hole 95 to be inserted into a threaded hole 98 of the L-segment 70.

Referring to FIG. 12C, the support section 22 is shown attached to the chair having the longest leg length 68 (e.g., 27 inches). To accommodate this longest leg length, the adjustable element is formed by utilizing inner-most hole 97, instead of the hole 98, in the L-segment 70. As described above, the bolt 64 passes through the hole 95 and is inserted into a threaded hole 97 of L-segment 70.

Of course in these embodiments, the T-segment 80 could be substituted for the L-segment 70. Further, any number of T-segments 80 and L-segments 70 could be utilized with a corresponding number of support sections 22 to provide the desired number of support sections 22 attached to substantially horizontally-extending legs.

Further, as with the previous embodiments of the footrest, the support section 22 may be angled as shown in FIGS. 3A and 3B, e.g. to 30° from the horizontal. Further, the support section may have grooves or tactile bumps on its upper surface as shown in FIGS. 4A, 4B, and 4C.

Figure 13A:
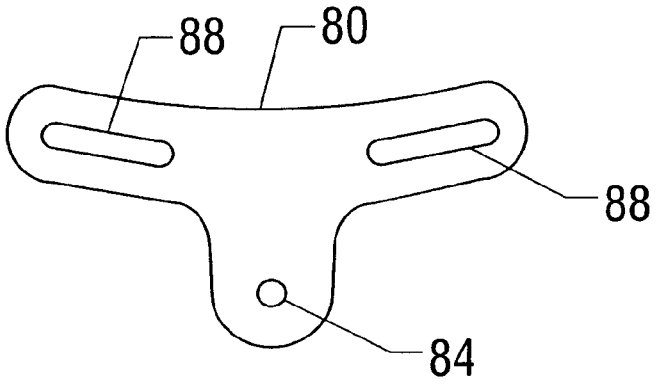
FIGS. 13A–13C show embodiments of the present invention including elongated slots.
Figure 13B:
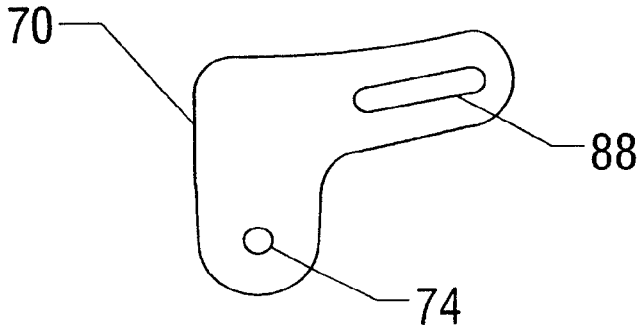

FIGS. 13A and 13B show another embodiment of the present invention in which slots 88 are utilized to form the adjustable element, instead of holes 97, 98, and 99 in the connectors, or holes 91, 92, and 93 in the support section as described in previous examples. Should these slots be utilized, nuts (not shown) or any other connection means could be utilized to secure the connector to the bolt.

For example, FIG. 13A shows T-segment 80 having post hole 80 and slots 88. T-segment 80 could be sandwiched between the caster 16 and the substantially horizontally-extending leg 14 by the post 62 of the caster 16 passing through the post hole 84 in the T-segment 80.

The adjustable element could be formed when connecting the support section 22 having only one hole on each end (as shown in FIGS. 12A–C). A bolt 64 may pass through one hole of support section 22, and align in a location in the elongated slot of the connector (i.e. either the T-segment of FIG. 13A or the L-segment of FIG. 13B) appropriate for a given chair size. When being installed on a chair of a different chair size, i.e. a chair having a different length of legs, the bolt would align in a different location in the elongated slot as appropriate. A nut or any other fastening means could be used to releasably secure the bolt into the appropriate location in the elongated slot of the connector.

Referring to FIG. 13B, L-segment 70 is shown having post hole 74 and elongated slot 88. L-segment 70 could be sandwiched between the caster 16 and the substantially horizontally-extending leg 14 by the post 62 of the caster 16 passing through post hole 74 in L-segment 70. The adjustable element could be formed when connecting the support section 22 having only one hole on each end (as shown in FIGS. 12A–C). A bolt 64 or other connecting means may pass through one hole of the support section 22, and align in a location in the elongated slot of the connector, here the L-segment 70 appropriate for a given chair size. When being installed on a chair of a different chair size, i.e. a chair having a different length of legs, the bolt would align in a different location in the slot as appropriate. A nut or any other fastening means could be used to releasably secure the bolt into the appropriate location in the slot of the connector.

Figure 11B:
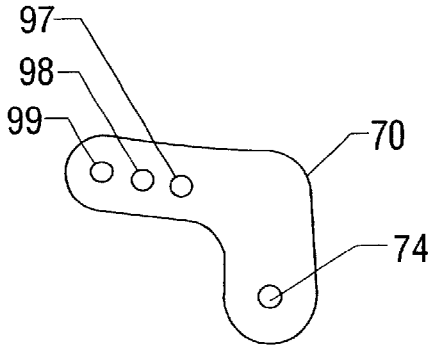
Figure 11C:
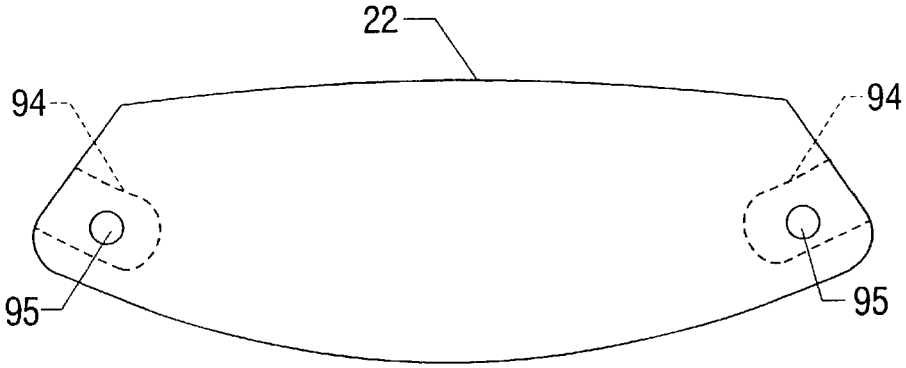
Figure 13C:
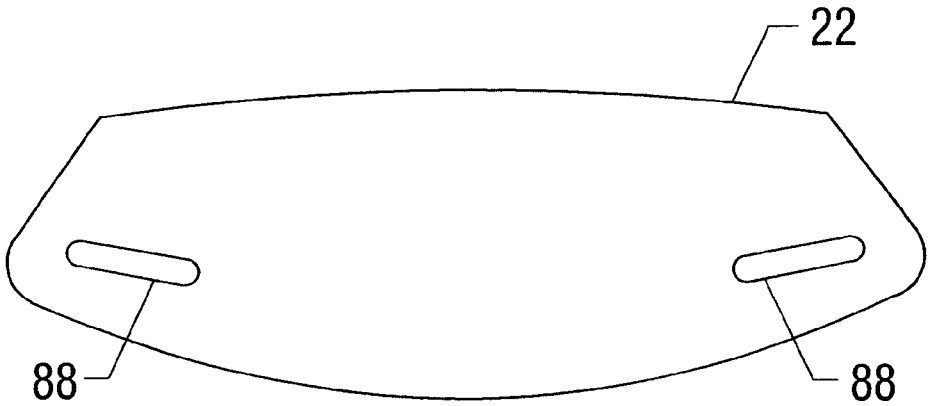

Alternatively, the elongated slot (which provides the adjustment in these embodiments) could be located in the support section 22 as shown in FIG. 13C. The support section 22 having elongated slots 88 could be attached to the substantially horizontally-extending chair legs 14 utilizing bolts passing through slots 88. Connectors utilized with this embodiment could be T-segment having slots (FIG. 13A), L-segment having slots (FIG. 13B), T-segment having holes (FIG. 11A), L-segment having holes (FIG. 11B), T-segment having one hole (FIG. 8A), L-segment having one hole (FIG. 8B), or any other configuration that defines an adjustable element.

Although various embodiments have been shown and described, the invention is not so limited and will be understood to include all such modifications and variations as would be apparent to one skilled in the art.

The following table lists the description and the numbers as used herein and in the drawings attached hereto:

| Reference | Name |
|---|---|
| 14 | Chair Leg |
| 22 | Support section |
| 23 | Footrest |
| 60 | Chair Leg Length |
| 62 | Castor Post |
| 64 | Bolt |
| 66 | Center of Chair |
| 67 | Second chair leg length |
| 68 | Third chair leg length |
| 70 | L-segment |
| 72 | L-segment post hole |
| 74 | L-segment post hole |
| 80 | T-segment |
| 82 | T-segment post hole |
| 84 | T-segment hole |
| 87 | Upper surface of Support Section 22 |
| 88 | Elongated Slot |
| 90 | Footrest Segment |
| 91 | First attachment means |
| 92 | Second attachment means |
| 93 | Third attachment means |
| 94 | Slot |
| 95 | Hole |

What is claimed is:

1. A footrest for use with different sizes of chairs, the chairs having a plurality of substantially horizontally-extending legs, the footrest comprising:

a first support section adapted to receive a bottom surface of a user's footwear, the first support section having a first end and a second end;

a first connector being removably attachable to one of the plurality of the substantially horizontally-extending legs of the chair, the first connector being removably attachable to the first end of the first support section thus defining a first adjustable element;

a second connector being removably attachable to one of the plurality of the substantially horizontally-extending legs of the chair, the second connector being removably attachable to the second end of the support section thus defining a second adjustable element;

a second support section adapted to receive the bottom surface of the user's footwear, the second support section having a first end and a second end, the second connector being removably attachable to the first end of the second support section thus defining a third adjustable element; and a third connector, the third connector being removably attachable to one of the plurality of substantially horizontally-extending legs of the chair, the third connector being removably attachable to the second end of the second support section thus defining a fourth adjustable element, the first and second adjustable elements allowing the first support section to be used for chairs of different sizes, the third and fourth adjustable elements allowing the second support section to be used for chairs of different sizes.

2. The footrest of claim 1 in which the second connector is a T-segment.

3. The footrest of claim 1 in which the first adjustable element further comprises a connecting means, the first connector having at least one hole, the first end of the support section having at least one hole, and the first end of the support section having a slot to receive a first end of the first connector, the connecting means attaching the first end of the support section to the first end of the first connector by alignment of the hole in the first end of the first connector with the hole in the first end of the support section.

4. The footrest of claim 1 in which the first connector is an L-segment being inserted into a slot on the first end of the support section.

5. The footrest of claim 1 in which the first adjustable element is a T-segment being inserted into a slot on the first end of the support section.

6. The footrest apparatus of claim 1 in which an upper surface of the support section further comprises tactile bumps.

7. The footrest apparatus of claim 1 in which an upper surface of the support section further comprises the upper surface of the support section being angled from a horizontal plane.

8. The footrest apparatus of claim 7 in which the angle the upper surface of the support section forms with the horizontal plane is between 10° and 40°.

9. The footrest apparatus of claim 8 in which the angle the upper surface of the support section forms with the horizontal plane is 30°.

10. The footrest of claim 1 in which the second adjustable element further comprises a second connecting means, the second connector having at least one hole, the first end of the second support section having at least one hole, and the first end of the support section having a slot to receive a first end of the first connector, the second connecting means attaching the first end of the second support section to the first end of the second connector by alignment of the hole in the first end of the second connector with the hole in the first end of the second support section.

11. The footrest of claim 1 in which the second connector is an L-segment being inserted into a slot on the first end of the second support section.

12. The footrest apparatus of claim 1 in which an upper surface of the second support section further comprises tactile bumps.

13. The footrest apparatus of claim 1 in which an upper surface of the second support section further comprises the upper surface of the second support section being angled from a horizontal plane.

14. The footrest apparatus of claim 13 in which the angle the upper surface of the support section forms.with the horizontal plane is 30°.

15. The footrest of claim 1 in which at least one of the third or fourth adjustable elements is a T-segment.

16. The footrest of claim 1 in which at least one of the third or fourth adjustable elements is an L-segment.

17. A footrest for use with different sizes of chairs, the chairs having a plurality of substantially horizontally-extending legs, the footrest comprising:

a support section adapted to receive a bottom surface of a user's footwear, the support section having a first end and a second end;

a first connector being removably attachable to one of the plurality of the substantially horizontally-extending legs of the chair, the first connector being removably attachable to the first end of the support section thus defining a first adjustable element;

a second connector being removably attachable to one of the plurality of the substantially horizontally-extending legs of the chair, the second connector being removably attachable to the second end of the support section thus defining a second adjustable element;

a second support section adapted to receive the bottom surface of the user's footwear, the second support section having a first end and a second end, the second connector being removably attachable to the first end of the second support section to define a third adjustable element; and a third connector, the third connector being removably attachable to the plurality of the substantially horizontally-extending legs of the chair, the third connector being removably attachable to the second end of the second support section to define a fourth adjustable element, the first, second, third, and fourth adjustable elements allowing the support sections to be used for chairs of different sizes.

18. A footrest for use with different sizes of chairs, the chairs having five substantially horizontally-extending legs attached to five castors, the footrest comprising:

a first support section adapted to receive a bottom surface of a user's footwear, the first support section having a first end having three holes and a second end having three holes;

a second support section adapted to receive a bottom surface of a user's footwear, the second support section having a first end with three holes and a second end with three holes;

a first connector being removably attachable to one of the substantially horizontally-extending legs of the chair by sandwiching the first connector between the substantially horizontally-extending leg and a first castor, the first connector being an L-segment removably attached to the first end of the first support section by a first bolt inserted into one of the three holes in the first end of the first support section thus defining a first adjustable element;

a second connector being removably attachable to one of the substantially horizontally-extending legs of the chair by sandwiching the first connector between the substantially horizontally-extending leg and a second castor, the second connector being a T-segment removably attached to the second end of the first support section by a bolt inserted into one of the three holes in the second end of the first support section thus defining a second adjustable element, the T-segment removably attached to the first end of the second support section by a third bolt inserted into one of the three holes in the first end of the second support section thus defining a third adjustable element;

a third connector being removably attachable to one of the substantially horizontally-extending legs of the chair by sandwiching the third connector between the substantially horizontally-extending leg and a third castor, the third connector being an L-segment removably attached to the second end of the second support section by a bolt inserted into one of the three holes in the second end of the second support section thus defining a fourth adjustable element;

the first, second, third, and fourth adjustable elements allowing the support section to be used for chairs of different sizes.

19. A footrest for use with different sizes of chairs, the chairs having a plurality of substantially horizontally-extending legs, the footrest comprising:

a support section adapted to receive a bottom surface of a user's footwear, the support section having a first end, a second end, and an upper surface;

a first connector being removably attachable to one of the plurality of the substantially horizontally-extending legs of the chair, the first connector being removably attachable to the first end of the support section thus defining a first adjustable element;

a second connector being removably attachable to one of the plurality of the substantially horizontally-extending legs of the chair such that the upper surface of the support section is located below an upper surface of the plurality of substantially horizontally-extending legs when the second connector is mounted to one of the plurality of substantially horizontally-extending legs, the second connector being removably attachable to the second end of the support section thus defining a second adjustable element;

a second support section adapted to receive the bottom surface of the user's footwear, the second support section having a first end and a second end, the second connector being removably attachable to the first end of the second support section thus defining a third adjustable element; and a third connector, the third connector being removably attachable to one of the plurality of substantially horizontally-extending legs of the chair, the third connector being removably attachable to the second end of the second support section thus defining a fourth adjustable element, the first and second adjustable elements allowing the first support section to be used for chairs of different sizes, the third and fourth adjustable elements allowing the second support section to be used for chairs of different sizes.

20. A footrest for use with different sizes of chairs, the chairs having a plurality of substantially horizontally-extending legs, the footrest comprising:

a support section adapted to receive a bottom surface of a user's footwear, the support section having a first end, a second end, and an upper surface;

a first connector being removably attachable to one of the plurality of the substantially horizontally-extending legs of the chair, the first connector being removably attachable to the first end of the support section thus defining a first adjustable element;

a second connector being removably attachable to one of the plurality of the substantially horizontally-extending legs of the chair such that the upper surface of the support section is located below an upper surface of the plurality of substantially horizontally-extending legs when the second connector is mounted to one of the plurality of substantially horizontally-extending legs, the second connector being removably attachable to the second end of the support section thus defining a second adjustable element;

a second support section adapted to receive the bottom surface of the user's footwear, the second support section having a first end and a second end, the second connector being removably attachable to the first end of the second support section to define a third adjustable element; and a third connector, the third connector being removably attachable to the plurality of the substantially horizontally-extending legs of the chair, the third connector being removably attachable to the second end of the second support section to define a fourth adjustable element, the first, second, third, and fourth adjustable elements allowing the support sections to be used for chairs of different sizes.

* * * * *